US010883701B2

(12) United States Patent
Wang et al.

(10) Patent No.: US 10,883,701 B2
(45) Date of Patent: Jan. 5, 2021

(54) LED LIGHTING DEVICE

(71) Applicant: OPPLE LIGHTING CO., LTD., Shanghai (CN)

(72) Inventors: Cong Wang, Shanghai (CN); Jian Zhu, Shanghai (CN); Kai Wang, Shanghai (CN); Guoping Zhang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 71 days.

(21) Appl. No.: 16/287,588

(22) Filed: Feb. 27, 2019

(65) Prior Publication Data

US 2019/0264891 A1 Aug. 29, 2019

Related U.S. Application Data

(63) Continuation of application No. PCT/CN2017/097208, filed on Aug. 11, 2017, and a (Continued)

(30) Foreign Application Priority Data

Aug. 30, 2016 (CN) ..... 2016 1 0783396
Aug. 30, 2016 (CN) ..... 2016 1 0783397

(Continued)

(51) Int. Cl.
*F21V 5/04* (2006.01)
*F21S 8/02* (2006.01)

(Continued)

(52) U.S. Cl.
CPC ..... *F21V 5/046* (2013.01); *F21S 8/026* (2013.01); *F21V 5/007* (2013.01); *F21V 7/041* (2013.01);

(Continued)

(58) Field of Classification Search
CPC ..... F21V 5/046; F21V 5/007; F21V 7/041; F21V 5/00; F21V 5/04; F21V 5/043;

(Continued)

(56) References Cited

U.S. PATENT DOCUMENTS 7,488,097 B2 * 2/2009 Reisenauer ..... F21K 9/68 362/373
7,950,832 B2 * 5/2011 Tanaka ..... F21V 5/04 362/311.02

(Continued)

FOREIGN PATENT DOCUMENTS

CA 2883617 A1 8/2015
CN 2823771 Y 10/2006

(Continued)

OTHER PUBLICATIONS

International Search Report (including English translation) and Written Opinion issued in PCT/CN2017/097208, dated Sep. 27, 2017, 9 pages.

(Continued)

*Primary Examiner* — Bao Q Truong
(74) *Attorney, Agent, or Firm* — Arch & Lake LLP

(57) ABSTRACT

The present disclosure provides a LED lighting device including a housing, a light source component, an optical lens that is located above the light source component and is configured to distribute light for the light source component, a reflector in contact with the optical lens, and a surface ring assembled on the reflector; and the housing, the light source component, the optical lens, the reflector, and the surface ring are sequentially arranged; the surface ring is fixed on the housing to delimit a receiving chamber, the light source component, the optical lens, the reflector are all located in the receiving chamber; LED light source particles are located a light source base plate included in the light source component; light of the LED light source particles sequen- (Continued)

tially passes through the optical lens and the reflector, and then emits through a light exit of the LED lighting device.

18 Claims, 19 Drawing Sheets

Related U.S. Application Data continuation of application No. PCT/CN2017/106584, filed on Aug. 17, 2017.

(30) Foreign Application Priority Data

| | | |
|---|---|---|
| Aug. 30, 2016 | (CN) ..... | 2016 2 1013684 U |
| Aug. 30, 2016 | (CN) ..... | 2016 2 1013745 U |
| Oct. 19, 2016 | (CN) ..... | 2016 2 1138163 U |

(51) Int. Cl.

| | |
|---|---|
| *F21Y 115/10* | (2016.01) |
| *F21Y 103/33* | (2016.01) |
| *F21V 5/00* | (2018.01) |
| *F21Y 105/18* | (2016.01) |
| *F21V 7/04* | (2006.01) |

(52) U.S. Cl.

CPC ..... *F21Y 2103/33* (2016.08); *F21Y 2105/18* (2016.08); *F21Y 2115/10* (2016.08)

(58) Field of Classification Search

CPC ..... F21V 13/00; F21V 13/02; F21V 13/04; F21V 13/045; F21V 13/06; F21S 8/026; F21Y 2105/18; F21Y 2103/33; F21Y 2115/10

See application file for complete search history.

(56) References Cited

U.S. PATENT DOCUMENTS

| | | | | |
|---|---|---|---|---|
| 8,573,809 | B2 * | 11/2013 | Nakamura | F21V 5/08 362/268 |
| 2010/0172143 | A1 * | 7/2010 | Cunius | F21V 29/83 362/373 |
| 2011/0216543 | A1 | 9/2011 | Kayanuma | |
| 2014/0204594 | A1 * | 7/2014 | Kanazawa | F21V 21/30 362/362 |

FOREIGN PATENT DOCUMENTS

| | | | |
|---|---|---|---|
| CN | 201851962 | U | 6/2011 |
| CN | 202647387 | U | 1/2013 |
| CN | 203464067 | U | 3/2014 |
| CN | 105202394 | A | 12/2015 |
| CN | 105202482 | A | 12/2015 |
| CN | 205037137 | U | 2/2016 |
| CN | 205037253 | U | 2/2016 |
| CN | 206072988 | U | 4/2017 |
| DE | 102012007206 | A1 | 10/2013 |
| GB | 2506019 | A | 3/2014 |
| WO | 2011120410 | A1 | 10/2011 |

OTHER PUBLICATIONS

International Search Report (including English translation) and Written Opinion issued in PCT/CN2017/106584, dated Jan. 16, 2018, 10 pages.

European Extended Search Report issued in EP17845197.7, dated Jul. 3, 2019, 8 pages.

* cited by examiner

LED LIGHTING DEVICE

CROSS-REFERENCE TO RELATED APPLICATIONS

This application is based upon and claims the priority of PCT patent application No. PCT/CN2017/097208 filed on Aug. 11, 2017 which claims the priority of Chinese Patent Application No. 201610783396.0 filed on Aug. 30, 2016, Chinese Patent Application No. 201610783397.5 filed on Aug. 30, 2016, Chinese Patent Application No. 201621013684.X filed on Aug. 30, 2016 and Chinese Patent Application No. 201621013745.2 filed on Aug. 30, 2016, and PCT patent application No. PCT/CN2017/106584 filed on Oct. 17, 2017 which claims the priority of Chinese Patent Application No. 201621138163.7 filed on Oct. 19, 2016, the entire content of all of which is hereby incorporated by reference herein for all purposes.

TECHNICAL FIELD

The present disclosure relates to a lighting device, and particularly to a light-emitting diode (LED) lighting device.

BACKGROUND

In the global energy shortage, LED is widely used in the field of lighting devices as a new solid-state light source for its advantages of energy saving, high efficiency, environmental protection, flexible control, safety, reliability, and good orientation.

SUMMARY

The present disclosure provides a LED lighting device, a lens assembly and a method of manufacturing a LED lighting device.

According to one aspect of the present disclosure, a LED lighting device is provided. The device may include a housing, a light source component, an optical lens located above the light source component and where the optical lens is configured to distribute light for the light source component, a reflector in contact with the optical lens, and a surface ring assembled on the reflector.

In the device, the housing, the light source component, the optical lens, the reflector and the surface ring are sequentially arranged; the surface ring is fixed on the housing to delimit a receiving chamber, the light source component, the optical lens and the reflector are located in the receiving chamber; and the light source component comprises a light source base plate and LED light source particles are located on the light source base plate, light of the LED light source particles sequentially passes through the optical lens and the reflector and then emits through a light exit of the LED lighting device.

According to another aspect of the present disclosure, a lens assembly is provided for at least placing a first light source and a second light source. The lens assembly may include a first lens, where the first lens is in a shape of a ring and comprises a first light-entering surface, a first light-emitting surface and a first placement space on a side of the first light-entering surface for placing the first light source, and both the first light-entering surface and the first light-emitting surface are curved surfaces; a second lens, where the second lens comprises a second light-entering surface, a second light-emitting surface and a second placement space on a side of the second light-entering surface for placing the second light source, and both the second light-entering surface and the second light-emitting surface are curved surfaces.

In the lens assembly, the first light-emitting surface and/or the first light-entering surface is provided with a plurality of ridges uniformly distributed along an extension direction of the first lens, each of the ridges extends in a shape of a curve along the first lens, and a projection of each of the ridges in a horizontal direction is a straight line.

According to a third aspect of the present disclosure, a method of manufacturing a LED lighting device is provided. The method may include providing a housing, a light source component, and an optical lens located above the light source component and where the optical lens is configured to distribute light for the light source component; providing a reflector in contact with the optical lens and a surface ring assembled on the reflector; sequentially arranging the housing, the light source component, the optical lens, the reflector and the surface ring; fixing the surface ring on the housing to delimit a receiving chamber, and positioning the light source component, the optical lens and the reflector in the receiving chamber; and placing the LED light source particles on a light source base plate comprised in the light source component where light of the LED light source particles sequentially passes through the optical lens and the reflector and then emits through a light exit of the LED lighting device.

It is to be understood that both the foregoing general description and the following detailed description are exemplary and explanatory only and are not restrictive of the present disclosure.

BRIEF DESCRIPTION OF THE DRAWINGS

In order to more clearly explain the technical solutions of the present disclosure or in the existing technology, the drawings necessary for the description of the examples or the existing technology will be briefly described below. Apparently, the described drawings are just a part but not all of the examples of the present disclosure. Based on the described figures herein, those skilled in the art can obtain other figures, without any inventive work.

DETAILED DESCRIPTION

In order to make objectives, technical solutions and advantages of the present disclosure more apparent, the technical solutions of the present disclosure will be described clearly and completely in connection with the examples and the corresponding drawings of the present disclosure. Apparently, the described examples are just a part but not all of the examples of the present disclosure. Based on the examples in the present disclosure, those skilled in the art can obtain other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

LED downlight is a lighting device which has been improved and developed based on some downlights combined with LED lighting technology. A lot of LED downlights use a direct-lit structure of a LED light source matched with a one-staged reflector or multi-staged reflectors or use an edge-lit attached structure of a LED light source matched with a light guide plate, which usually involves product defects such as low luminous efficiency, high glare, large size and high cost. Some high-end products of a few brands possess technical advantages such as high luminous efficiency, low glare and compact structure, which, however, are higher in price and hence are difficult to meet the market demand for large-scale applications.

Therefore, in order to overcome the above drawbacks, it is necessary to provide an improved LED lighting device.

Figure 1:
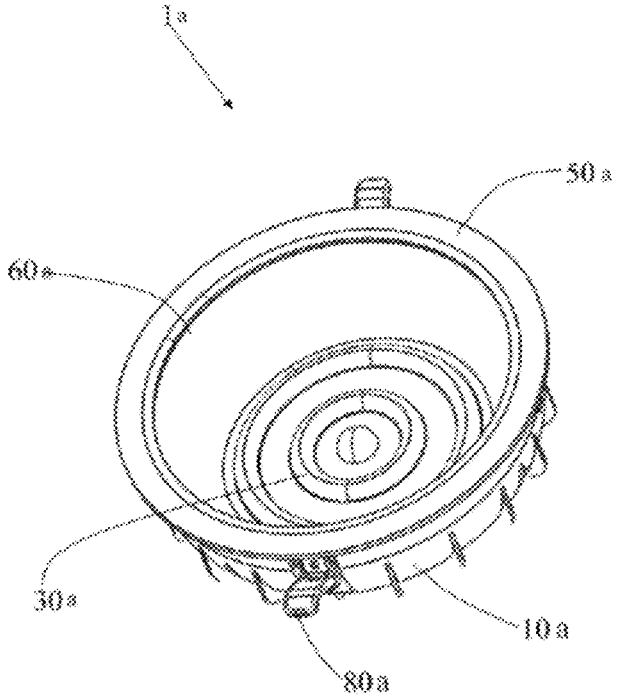
FIG. 1 is a stereographic view of a first example of a LED lighting device of the present disclosure.
Figure 2:
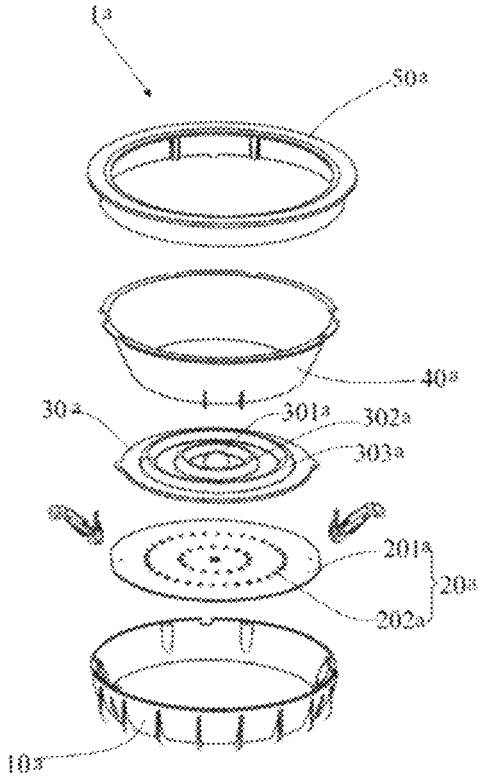
FIG. 2 is an exploded stereographic view of the first example of the LED lighting device of the present disclosure.
Figure 3:
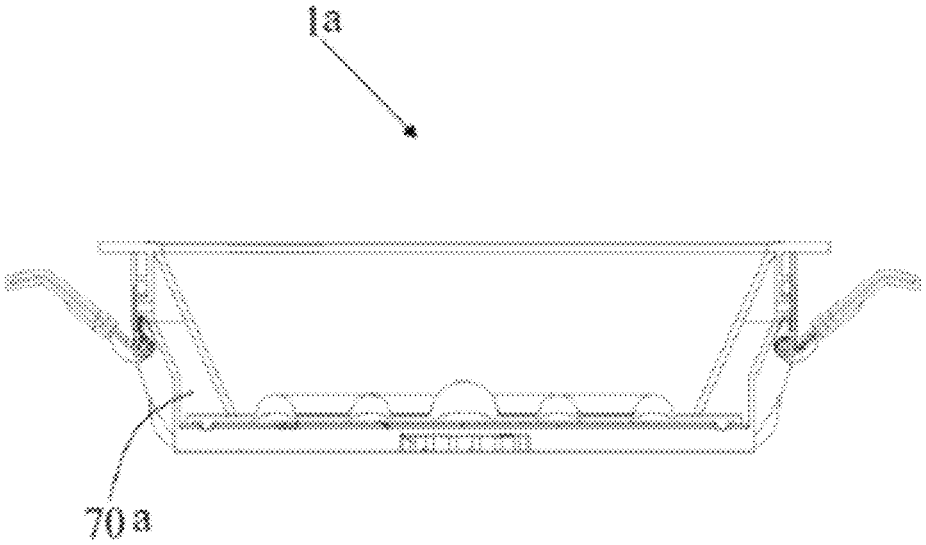
FIG. 3 is a lateral perspective view of the LED lighting device of the present disclosure.

Referring to FIG. 1 to FIG. 3, a LED lighting device 1*a* according to a first example of the present disclosure includes a housing 10*a*, a light source component 20*a*, an optical lens 30*a* located above the light source component 20*a* and configured to distribute light for the light source component 20*a*, a reflector 40*a* in contact with the optical lens 30*a*, and a surface ring 50*a* assembled on the reflector 40*a*. The housing 10*a*, the light source component 20*a*, the optical lens 30*a*, the reflector 40*a* and the surface ring 50*a* are sequentially arranged. The surface ring 50*a* is fixed to the housing 10*a* to delimit a receiving chamber 70*a*. The light source component 20*a*, the optical lens 30*a* and the reflector 40*a* are all located in the receiving chamber 70*a*. The LED lighting device 1*a* has a light exit 60*a*. The light source component 20*a* includes a light source base plate 201*a* and LED light source particles 202*a* located on the light source base plate 201*a*. Light of the LED light source particles 202*a* sequentially passes through the optical lens 30*a* and the reflector 40*a*, and then emits through the light exit 60*a*. The LED lighting device 1*a* provided by the present disclosure enables light emitted from the LED lighting device 1*a* to be uniform and have no glare, so as to effectively improve the luminous effect without using a diffusing plate to homogenize light.

In an alternative example of the present disclosure, the light source component 20*a* may be snap-fitted with the optical lens 30*a*.

In an alternative example of the present disclosure, the reflector 40*a* is sandwiched between the surface ring 50*a* and the optical lens 30*a*.

Figure 4:
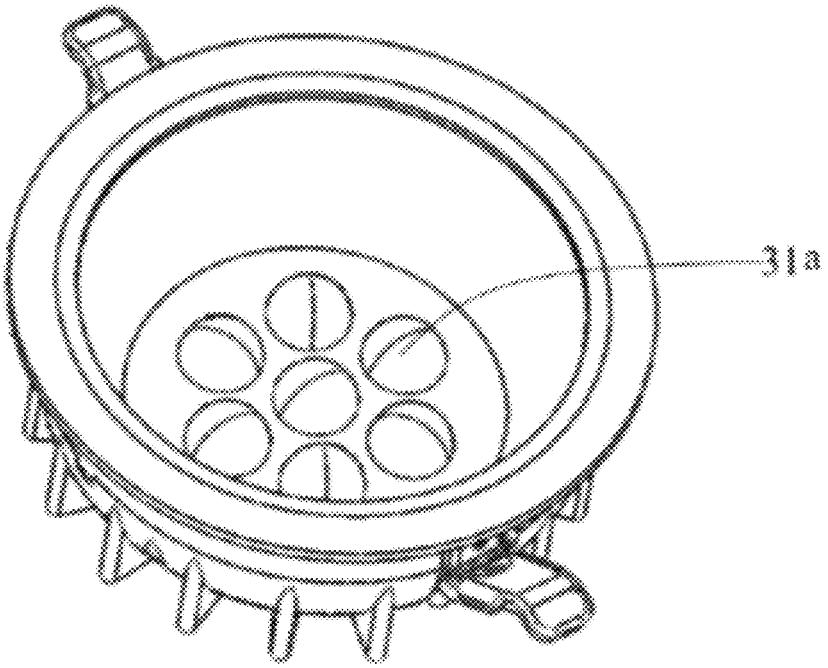
FIG. 4 is a stereographic view of a second example of a LED lighting device of the present disclosure.

The optical lens 30*a* may be in the form of one selected from or a combination of more than one selected from the group consisting of a ring lens, a single lens, and a lens array. In this example, as illustrated in FIG. 2, the light source component 20*a* may be divided into three portions, which respectively correspond to a first lens 301*a*, a second lens 302*a*, and a third lens 303*a* of the optical lens 30*a*. The first lens 301*a*, the second lens 302*a*, and the third lens 303*a* are disposed on the light source component 20*a* to respectively cover a corresponding light source; or, the first lens 301*a*, the second lens 302*a*, and the third lens 303*a* are connected to have an integral structure. The centrally located first lens 301*a* is a dot times and corresponds to at least one LED source particle; in FIG. 2, the first lens 301*a* corresponds to four LED source particles. The second lens 302*a* and the third lens 303*a* are both annular lenses surrounding the first lens 301*a*; a height of the first lens 301*a* is greater than a height of the second lens 302*a* and greater than a height of the third lens 303*a*; and the second lens 302*a* and the third lens 303*a* have the same height. In the second example of the present disclosure as illustrated in FIG. 4, the optical lens 31*a* is a lens array.

In this example, the height of the reflector 40*a* is greater than three times of the height of the optical lens 30*a*. Such a configuration enables the LED lighting device 1*a* to ensure that all the light emitted from the optical lens 30*a* can be completely reflected by the reflector 40*a* and then emit through the light exit 60*a*. In other examples, the height of the reflector 40*a* may not necessary be greater than three times of the height of the optical lens 30*a* but may be adjustable as needed; for example, the height of the reflector 40*a* may be only greater than two times of the height of the optical lens 30*a*, and the like.

In an alternative example of the present disclosure, a diameter of the reflector 40*a* is gradually increased from one end of the reflector connected to the optical lens 30*a* to the other end of the reflector 40*a*.

In an alternative example of the present disclosure, the reflector 40*a* and the optical lens 30*a* are fixed between the surface ring 50*a* and the housing 10*a* by being connected to and pressed by the surface ring 50*a*.

In an alternative example of the present disclosure, when the light source component 20*a* directly faces the light exit 60*a*, a portion of the light emitted from the LED light source particles 202*a* is directly emitted through the light exit 60*a*, and another portion of the light emitted from the LED light source particles 202*a* is reflected by the reflector 40*a* and then is emitted through the light exit 60*a*. The light emitted from the light source particles 202*a*, upon passing through the optical lens 30*a*, is reflected by the reflector 40*a* firstly and then emitted through the light exit 60*a* of the LED lighting device 1*a*.

In an alternative example of the present disclosure, the LED lighting device 1*a* may further include a snap spring component 80*a* disposed at a periphery of the housing 10*a*. By using the snap spring component 80*a* in cooperation with the housing 10*a*, the LED lighting device 1*a* may be mounted to a region, for example, a ceiling or a wall, or may be directly mounted into a lighting appliance to allow the LED lighting device 1*a* to face an area to be irradiated by the lighting device. The LED lighting device provided by the example of the present disclosure may be a downlight or the like, which is not particularly limited in the present disclosure.

The present disclosure adopts the following technical solution: a LED lighting device, including: a housing, a light source component, an optical lens located above the light source component and configured to distribute light for the light source component, a reflector in contact with the optical lens, and a surface ring assembled on the reflector. The housing, the light source component, the optical lens, the reflector and the surface ring are sequentially arranged; the surface ring is fixed on the housing to delimit a receiving chamber, the light source component, the optical lens and the reflector are all located in the receiving chamber; the LED lighting device has a light exit; the light source component includes a light source base plate and LED light source particles located on the light source base plate; light of the LED light source particles sequentially passes through the optical lens and the reflector and then emits through the light exit.

Preferably, the light source component is snap-fitted with the optical lens.

Preferably, the reflector is sandwiched between the surface ring and the optical lens.

Preferably, a height of the reflector is greater than two times of a height of the optical lens.

Preferably, a height of the reflector is greater than three times of a height of the optical lens.

Preferably, the optical lens is one selected from or a combination of more than one selected from the group consisting of a ring lens, a single lens, and a lens array.

Preferably, a diameter of the reflector is gradually increased from an end of the reflector connected to the optical lens to the other end of the optical lens.

Preferably, the reflector and the optical lens are fixed between the surface ring and the housing by being connected to and pressed by the surface ring.

Preferably, in the case where the light source component directly faces the light exit, a portion of the light emitted from the LED light source particles is directly emitted through the light exit, and another portion of the light emitted from the LED light source particles is reflected by the reflector and then emitted through the light exit; the light emitted from the LED light source particles, upon passing through the optical lens, is reflected by the reflector firstly and then emitted through the light exit of the LED lighting device.

Preferably, the light source component includes three portions corresponding to a first lens, a second lens and a third lens of the optical lens, respectively.

Preferably, the first lens, the second lens, and the third lens are disposed on the light source component and each cover a corresponding light source; or the first lens, the second lens, and the third lens are connected to have an integral structure.

Preferably, the first lens that is centrally located is a dot lens and corresponds to at least one LED light source particle.

Preferably, the second lens and the third lens are both annular lenses surrounding the first lens, and wherein a height of the first lens is greater than a height of the second lens and is greater than a height of the third lens, and the second lens and the third lens have a same height.

Preferably, the LED lighting device further includes a snap spring component disposed at a periphery of the housing.

Preferably, the LED lighting device is a downlight.

Compared with other options, the LED lighting device of the present disclosure has the following advantages: it has no need of providing a diffusing plate to homogenize light, which increases the luminous efficiency and meanwhile preventing from glare, so as to achieve a good lighting effect.

An illumination device usually comprises a light source module and a lens matched with the light source module, and the lens is used to focus or collimate the light emitted from the light source module.

Sometimes, in order to achieve the above purpose of focusing or collimating light, in a case that the illumination device comprises a plurality of light sources, one lens covering one of the light sources is arranged for each of the light sources, so that the illumination device comprising the plurality of light sources requires to arrange a plurality of lenses.

However, in a case that one lens covering one of the light sources is arranged for each of the light sources, since the lenses are inevitably different with each other due to the manufacturing processes, it is difficult to ensure that the light emitted from different light sources and passing through different lens disposed on the different light sources can obtain a same light distribution effect, and thus the illumination effect of the illumination device is affected.

The third example of the present disclosure provides an illumination device to solve the problem that it is difficult to ensure that the light emitted from the different light sources and passing through different lens disposed on the different light sources can obtain a uniform light distribution.

Figure 5:
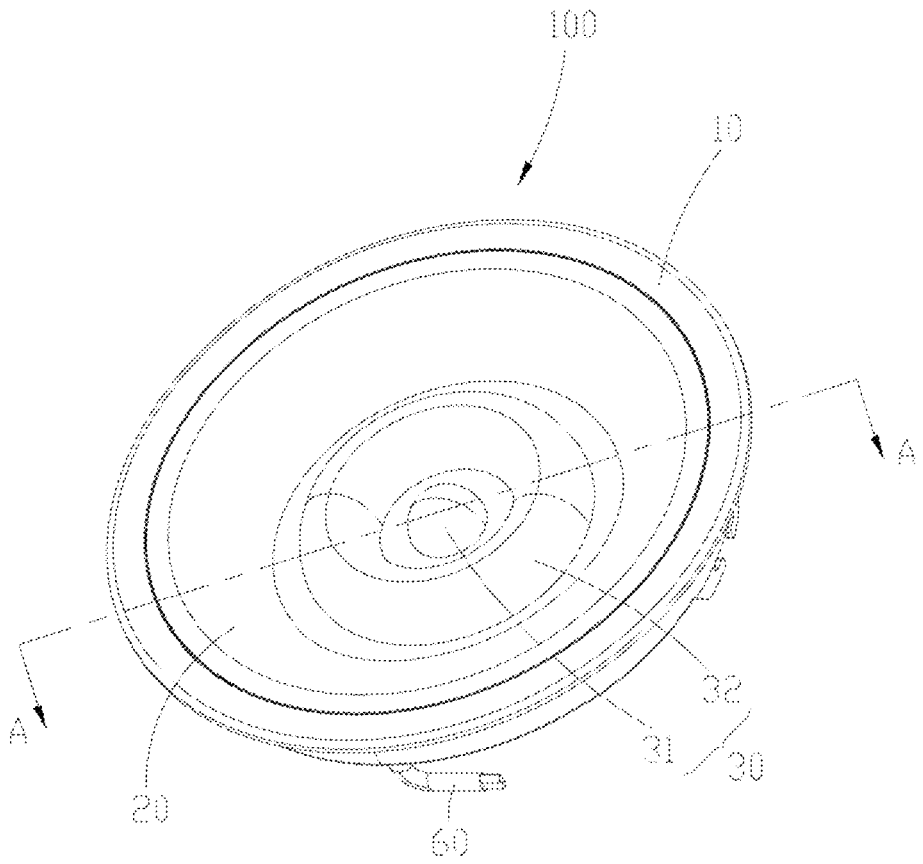
FIG. 5 is a three-dimensional diagram of an illumination device provided by a third example of the present disclosure.
Figure 6:
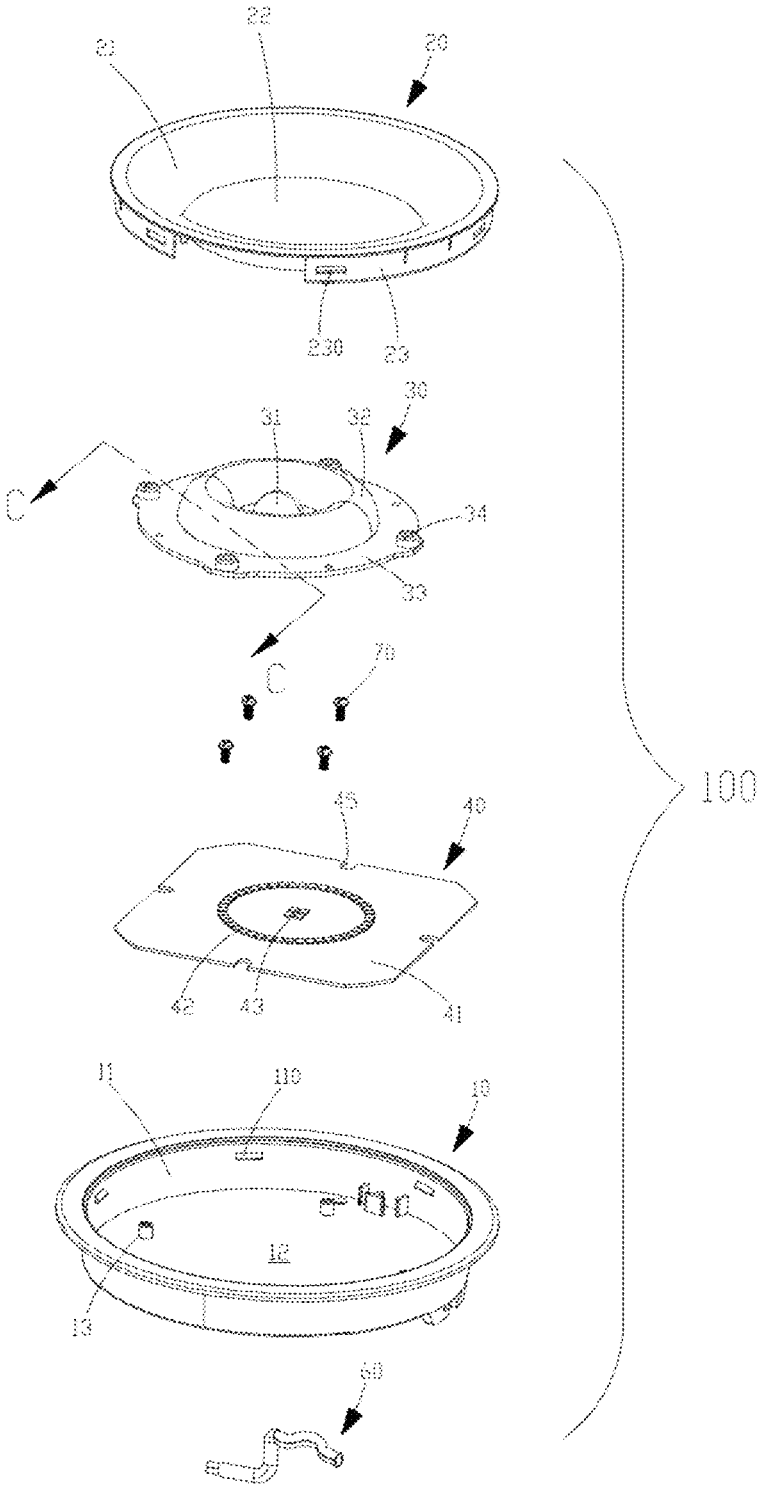
FIG. 6 is a three-dimensional exploded diagram of the illumination device provided by the third example of the present disclosure.

As illustrated in FIG. 5 and FIG. 6, the illumination device 100 of the present example comprises a shell 10, a light source module 40 arranged in the shell 10 and a lens assembly 30 matched with the light source module 40.

The light source module 40 comprises: a substrate 41, a plurality of first light sources 42 arranged in a ring and on a first surface 410 of the substrate 41, and at least one second light source 43 arranged on the first surface 410 of the substrate 41. The at least one second light source 43 is located at a center of the ring of the first light sources 42. The first light sources 42 and the at least one second light source 43 are light-emitting diodes (LEDs) or other types of light-emitting elements. The light source module 40 further comprises an electronic element (not shown in the drawings) arranged on the substrate 41. The light source module 40 may be integrated with a driving module (not shown in the drawings) for driving the light source module 40, and the driving module may be integrated on the first surface 410 of the substrate 41 or on a second surface opposite to the first surface.

Correspondingly, the lens assembly 30 comprises: a base 33 for matching with the substrate 41 of the light source module 40, a first lens 32 in a shape of a circular ring and connected to the base 33, and a second lens 31 connected to the base 33 and located at a ring center of the first lens 32. The first lens 32 is matched with the first light sources 42 of the light source module, and the second lens 31 is matched with the second light source 43 of the light source module 40.

It should be noted that, the lens assembly 30 is a lens component comprising at least two lenses, the at least two lenses are integrally arranged or separately arranged, and the number of the lenses in the lens assembly 30 is not limited. In the example of the present application, the second lens 31 is in a shape of a circular ring or in a shape of a non-circular ring (for example, in a shape of a dot). Preferably, in a case that both the first lens 32 and the second lens 31 are in the shape of the circular ring, the ring center of the first lens 32 (that is, the center of the ring formed by the lens) coincides with a ring center of the second lens 31. In a case that the first lens 32 is in the shape of the circular ring and the second lens 31 is in the shape of the dot, the second lens 31 is located at the ring center of the first lens 32. Further, in a case where the second lens 31 is in a shape of a round dot, a center of the round dot of the second lens 31 is arranged to be coincide with the ring center of the first lens 32. In the other feasible examples of the present application, a position relationship between the first lens 32 and the second lens 31 is not limited.

Preferably, in order to further enhance the lighting effect and aesthetics of the illumination device 100, the illumination device 100 further comprises a reflective component 20 arranged in the shell 10 and arranged in a ring, and the reflective component 20 is provided on an outer side of the first lens 32 and surrounds the first lens 32. The reflective component 20 comprises an arc-shaped reflective surface 21 and an opening 22 for the lens assembly 30 to pass through in the process of installing. The reflective component 20 for example adopts mirror reflection, diffuse reflection or absorption type reflection and so on.

In the example of the present disclosure, the shell 10 comprises a bottom wall 12 and a side wall 11 connected to the bottom wall 12; a plurality of screw holes 13 for fixing are arranged on the bottom wall 12, and correspondingly, a plurality of notches 45 are arranged on the substrate 41 of the light source module 40. A plurality of through holes 34 for fixing are arranged on the base 33 of the lens assembly 30. The side wall 11 of the shell 10 is further provided with a plurality of protruding portions 110 protruding inward from the side wall 11. The reflective component 20 is further provided with an installation wall 23 for attaching to the side wall 11 of the shell 10. The installation wall 23 extends downward from an upper surface 24 of the reflective component 20 to form a vertical side wall and surrounds the reflective surface 21 of the reflective component 20, and the installation wall 23 is provided with a plurality of holding holes 230 for matching with the protruding portions 110.

In the process of installing, the light source module 40 is placed on the bottom wall 12 of the shell 10 firstly, and in the process of placing, the plurality of notches 45 of the light source module 40 are fitted to the plurality of screw holes 13 for fixing on the bottom wall 12 respectively, and then the lens assembly 30 is placed on the first surface 410 of the substrate 41 provided with the first light source 42. Similarly, in the process of placing, the positions of the plurality of the through holes 34 for fixing of the lens assembly 30 are aligned with the positions of the plurality of the screw holes 13 for fixing, and the light source module 40 and the lens assembly 30 are fixed in the shell 10 by bolts 70 matching with the screw holes 13 for fixing.

An assembling mode of the above light source module 40 and the lens assembly 30 is not limited to the above mode, and a mode of sticking, a mode of riveting and the like may be adopted. Subsequently, the reflective component 20 is placed on the base 33 of the lens assembly 30, and the reflective surface 21 surrounds the first lens 32 of the lens assembly 30. The reflective component 20 and the shell 10 are fixed with each other by the protruding portions 110 and the holding holes 230 matched with each other. After the process of installing, the upper surface 24 of the reflective component 20 is flush with an upper surface 14 of the shell 10, and an accommodation space 25 for placing the electronic element (not shown in the drawings) of the light source module 40 is formed between the reflective surface 21 and the side wall 11 of the shell 10. By placing the electronic element in the above-mentioned accommodation space 25, a thickness of the illumination device is effectively reduced, and thus the illumination device is lighter and thinner. The electronic element comprises the driving module (not shown in the drawings), and the driving module is also placed in the accommodation space 25.

The above driving module may be integrated with the light source module on the substrate 41. Similarly, the assembling mode of the reflective component 20 and the shell 10 is not limited to the above mode, and the mode of sticking, the mode of riveting and the like may be adopted.

It should be noted that, the illumination device 100 further comprises a wire 60 mounted at a bottom of the shell 10, and the wire 60 is electrically connected with the light source module 40.

Figure 7:
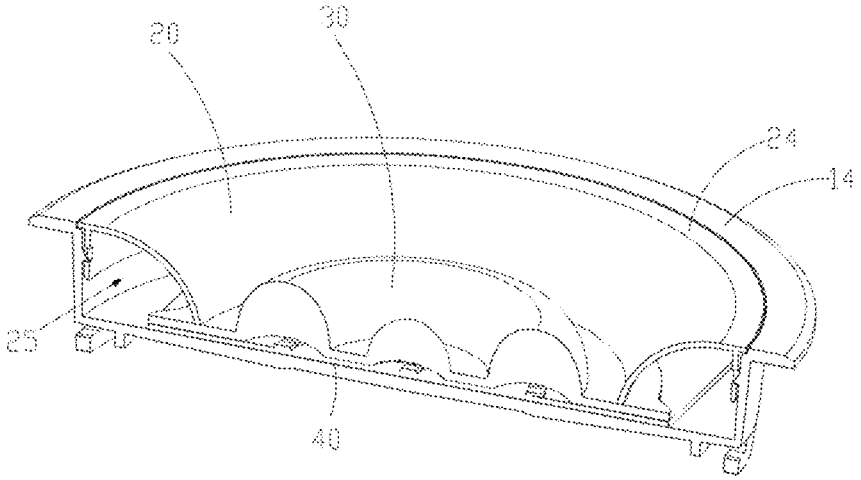
FIG. 7 is a three-dimensional cross-sectional schematic diagram of the illumination device taken along a direction of an A-A line of FIG. 5.
Figure 8:
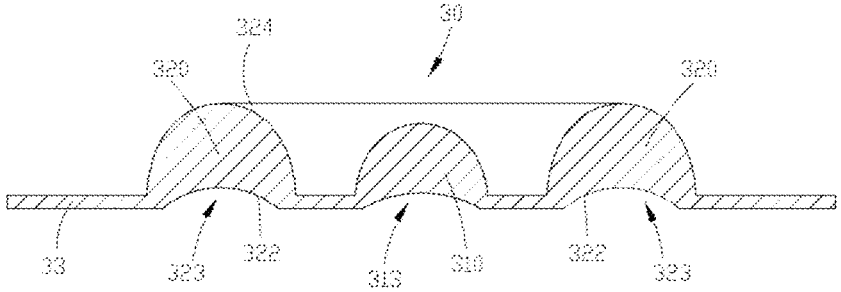
FIG. 8 is a cross-sectional schematic diagram of a lens assembly taken along the direction of the A-A line of FIG. 5.
Figure 9:
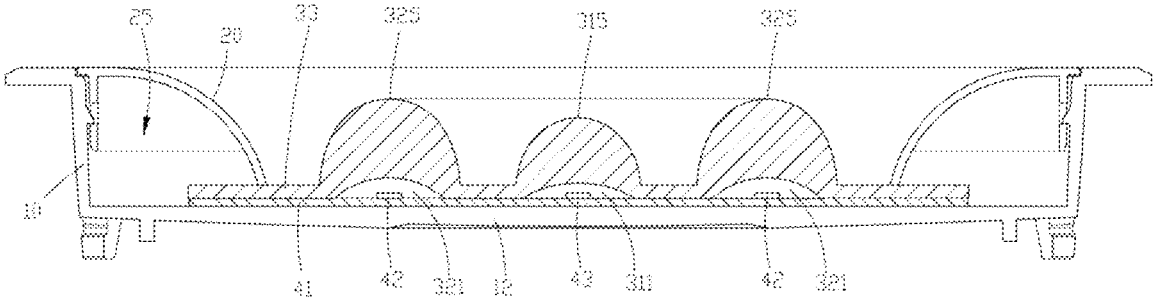
FIG. 9 is a main view of the three-dimensional cross-sectional schematic diagram shown in FIG. 7.

FIG. 7 to FIG. 7 are referred to, the cross sections shown in FIG. 7 to FIG. 9 are taken along a first section line (an A-A direction shown in FIG. 5), and the first section line passes through the ring center of the first lens 32. The first lens 32 comprises a first lens body 320 in a shape of a ring and a first groove 323 recessing inward from the base 33, and the second lens 31 comprises a second lens body 310 and a second groove 313 recessing inward from the base 33. The first lens comprises a first light-entering surface 322 and a first light-emitting surface 324 opposite to each other. After the lens assembly 30 and the light source module 40 are installed with each other, due to the existence of the first groove 323, a first cavity 321 for placing the first light sources 42 is formed between the first light-entering surface 322 and the first surface 410 (as illustrated in FIG. 6). Similarly, the second lens 31 comprises a second light-entering surface 312 and a second light-emitting surface 314 opposite to each other. After the lens assembly 30 and the light source module 40 are installed with each other, due to the existence of the second grooves 313, a second cavity 311 for placing the second light source 43 is formed between the second light-entering surface 312 and the first surface 410. The example of the present disclosure places the first light sources 42, arranged in the ring, of the light source module 40 in the first cavity 321 of the first lens 32; compared with the existing technology, more light sources are arranged in a limited space of the illumination device 100 in the example of the present disclosure, thereby the lighting effect of the illumination device 100 is improved. In addition, by adjusting the lens assembly 30, the number of the first light sources 42 placed in the first lens 32 is adjusted according to the required luminous flux. Moreover, the lens assembly 30 is compatible with a variety of packages and thus has a good compatibility, and the arrangement of the light sources on the substrate 41 is more flexible.

It should be noted that, in the example of the present disclosure, both the first light-entering surface 322 and the first light-emitting surface 324 of the first lens 32 are curved surfaces, and a curvature radius of the first light-entering surface 322 is larger than a curvature radius of the first light-emitting surface 324. Similarly, both the second light-entering surface 312 and the second light-emitting surface 314 of the second lens 31 are curved surfaces, and a curvature radius of the second light-entering surface 312 is larger than a curvature radius of the second light-emitting surface 314. Thus, after the light sources of the illumination device is installed in the lens assembly 30, the light emitted from the light sources emits outward after completely passing through the lens assembly 30. The first lens 32 having the curved surfaces and the second lens 31 having the curved surfaces make the luminous efficiency and the light distribution effect better. In the example of the present disclosure, the substrate 41 of the light source module 40 is attached with the base 33 of the lens assembly 30 to form the first cavity or the second cavity enclosed by the substrate 41 and the base 33. Therefore, each of the first light sources and the second light source are completely accommodated in the first cavity 321 or the second cavity 311, so as to ensure that all light passes through the lens assembly 30 and then emits outside the illumination device, and the luminous efficiency is high.

Referring to FIG. 8, in order to make the light distribution effect of light emitted from each of the light sources and passing through the lens assembly 30 in the illumination device is uniform (for example, a light distribution type of the emitted light is uniform), in the present example, a first cross section of the first lens 32 taken along the first section line is not the same as a second cross section of the second lens 31 along the first section line. In the present example, a height of the first lens 32 in a thickness direction of the base 33 is not equal to a height of the second lens 31 in the thickness direction of the base 33. That is to say, the height of the first lens 32 in the thickness direction of the base 33 is defined as a first vertical distance from a first top 325 of the first lens 32 to the base 33, the height of the second lens 31 in the thickness direction of the base 33 is defined as a second vertical distance from a second top 315 of the second lens 31 to the base 33, and then the first vertical distance is larger or less than the second vertical distance.

In an example, the first vertical distance is arranged to be larger than the second vertical distance. In particular, referring to FIG. 8 and FIG. 13, a maximum height of the first light-entering surface 322 of the first lens 32 in the thickness direction of the base 33 is slightly larger than a maximum height of the second light-entering surface 312 of the second lens 31 in the thickness direction of the base 33, and both of the maximum height of the first light-entering surface 322 and the maximum height of the second light-entering surface 312 are approximately close to the thickness of the base 33.

Figure 10:
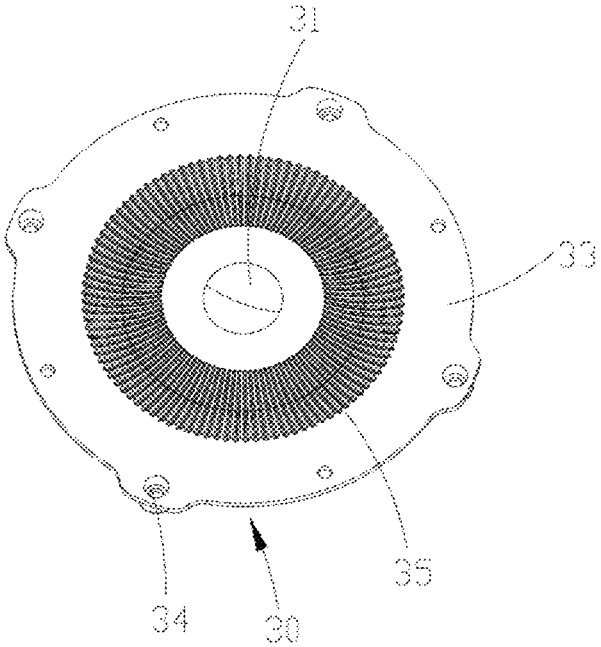
FIG. 10 is a structural schematic diagram of the lens assembly on a side provided with a light-entering surface in the third example of the present disclosure.

FIG. 10 is referred to, it is a schematic diagram of a side, provided with the light-entering surface, of the first lens. In practical application, a small number of light sources may be not lit, which results in a grain sense upon a person observes the illumination device with the lens assembly. In order to eliminate the grain sense and improve a visual effect, a grain-sense-elimination layer 35 with a concave-convex structure is formed on the first light-entering surface 322 or the first light-emitting surface 324 of the first lens 32 in the present example. The grain-sense-elimination layer 35 is a concave-convex component such as a "V-shaped" component integrally formed on at least one of the first light-entering surface 322 and the first light-emitting surface 324 of the first lens 32 in any form.

The grain-sense-elimination layer 35 with the concave-convex structure is arranged on both of the first light-entering surface 322 and the first light-emitting surface 324 at the same time. In a same principle, the grain-sense-elimination layer 35 is formed on the second light-entering surface or the second light-emitting surface of the second lens 31.

Figure 11A:
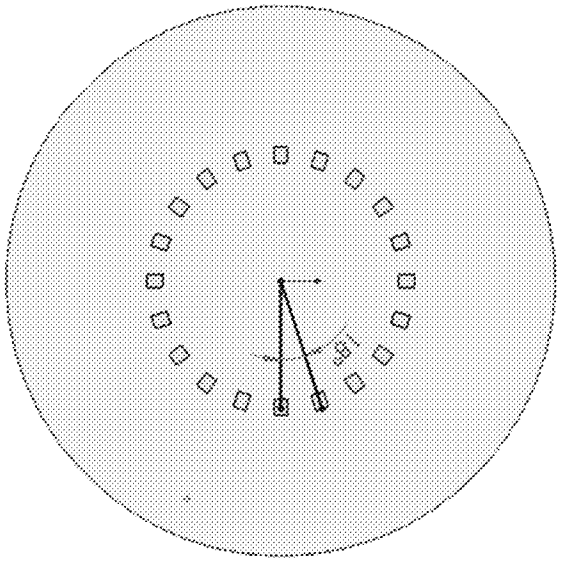
FIGS. 11*a* and 11*b* are schematic diagrams of arrangements of first light sources of a light source module in the third example of the present disclosure.
Figure 11B:
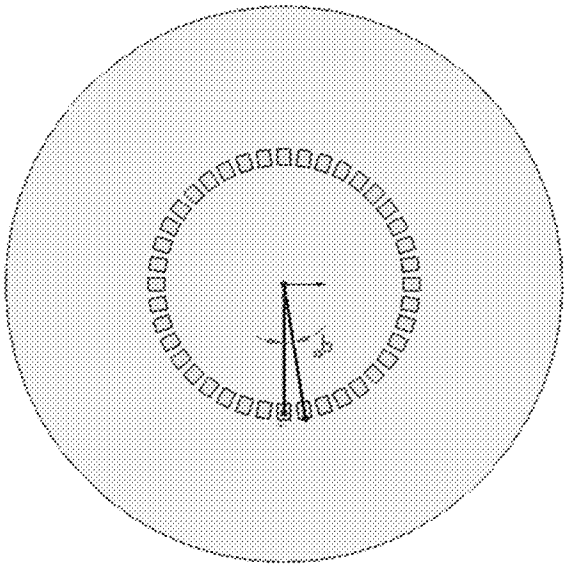

FIG. 11*a* and FIG. 11*b* are referred to, and FIG. 11*a* and FIG. 11*b* are schematic diagrams of arrangements of the first light sources of the light source module in the example of the present disclosure. It can be seen that the number of the first light sources 42 arranged in the ring is adjusted according to requirements. A distribution angle of the first light sources 42 is defined as: an angle between a connection line of one of the first light sources 42 to the center of the ring and a connection line of the other of the first light sources 42 to the center of the ring, and the one of the first light sources 42 and the other of the first light sources 42 are adjacent to each other. For example, the number of the first light source 42 in FIG. 11*a* is 20, and thus the distribution angle is 18°. The number of the first light source 42 in FIG. 11*b* is 40, and thus the distribution angle is 9°. In the example of the present disclosure, in order to eliminate a light spot phenomenon caused by a stretching direction of the ring-shaped first lens 32 being unable to control light, a concave-convex structure is formed on the first light-entering surface 322 or the first light-emitting surface 324 of the first lens 32. The concave-convex structure comprises one or more of etched structures formed by an etching process and abrasive structures formed by an abrasive process. In the present example, by the etched structures or the abrasive structures, a divergence angle of the light from the first light sources 42 meet the desired requirements after passing through the first lens.

Figure 12:
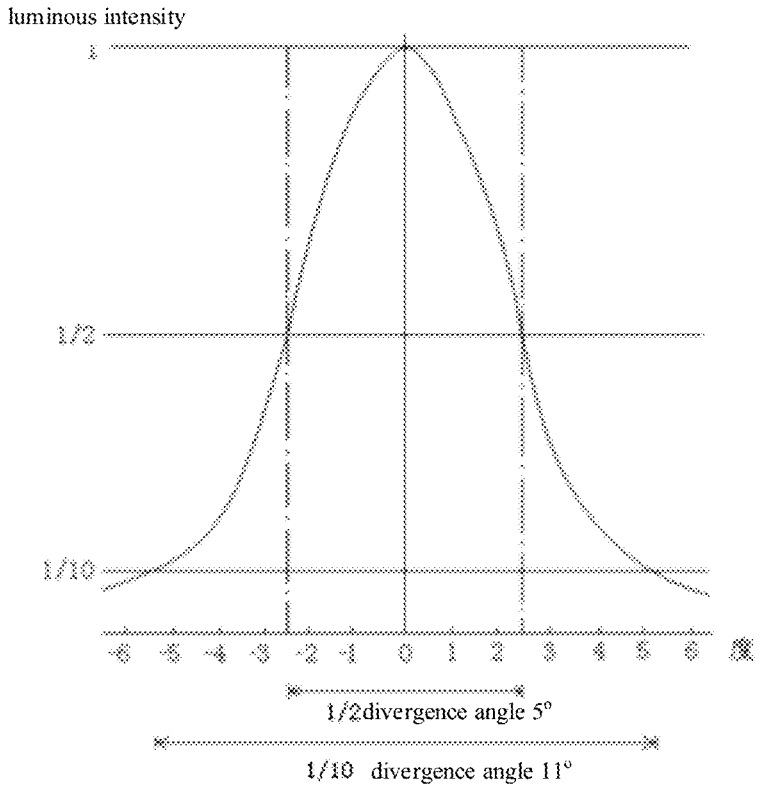
FIG. 12 is a schematic diagram of a light distribution curve in the third example of the present disclosure.

FIG. 12 is referred to, and FIG. 12 is a schematic diagram of a light distribution curve in the example of the present disclosure. The definition of the divergence angle is that: in a case that a beam of parallel light is incident on the first lens 32, the emitted light emitted from the first lens 32 and with an half-intensity is determined, the half-intensity is half of the maximum intensity of the emitted light emitted from the first lens 32, and the divergence angle refers to an angle formed by two emitted light with the half-intensity. For example, in the light distribution curve of FIG. 12, if the maximum intensity of the emitted light is 1 (the emitted light with the maximum intensity is concentrated at a position of a normal line of the first lens), then the emitted light with the half-intensity is distributed at positions of ±2.5° of the position of the normal line, so that the divergence angle is 5°.

In order to obtain uniform light spots, in the present example, the etched structures or the abrasive structures make the divergence angle of the first lens 32 positively related with the distribution angle of the first light sources 42. That is to say, in a case that the distribution angle becomes smaller, the divergence angle is reduced accordingly, and in a case that the distribution angle becomes larger, the divergence angle is increased accordingly. For example, in a case that the distribution angle is 18°, the divergence angle is 12°; and in a case that the distribution angle is 9°, the divergence angle is 6°.

Figure 13:
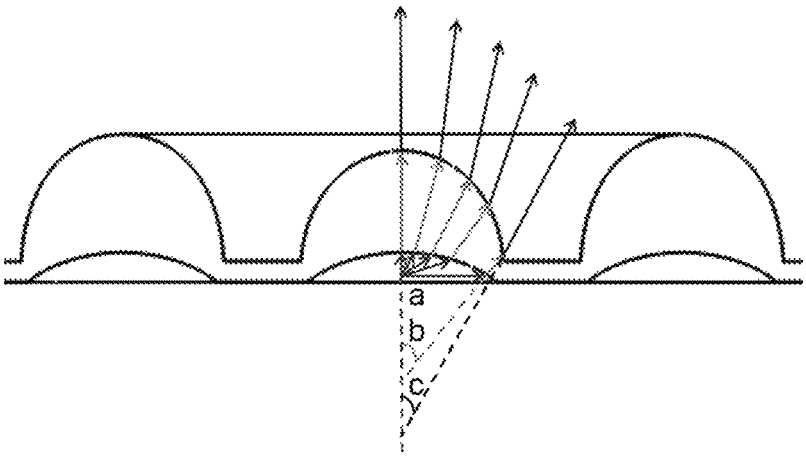
FIG. 13 is an optical path diagram of light emitted from the light sources and passing through a light-entering surface and a light-emitting surface of the lens in the third example of the present disclosure.

FIG. 13 is referred to, and FIG. 13 is an optical path diagram of the light emitted from the light source and passing through the lens. Both the light-entering surface and the light-emitting surface of the lens play a role of gathering light. An angle between the light emitted from the light source and the normal line is defined as a, an angle between the light emitted from the light source and refracted by the light-entering surface and the normal line is defined as b, and an angle between the light emitted from the light source, refracted by the light-entering surface and further refracted by the light-emitting surface and the normal line is defined as c. For example, the angle a ranges from 0° to 90°.

Figure 14:
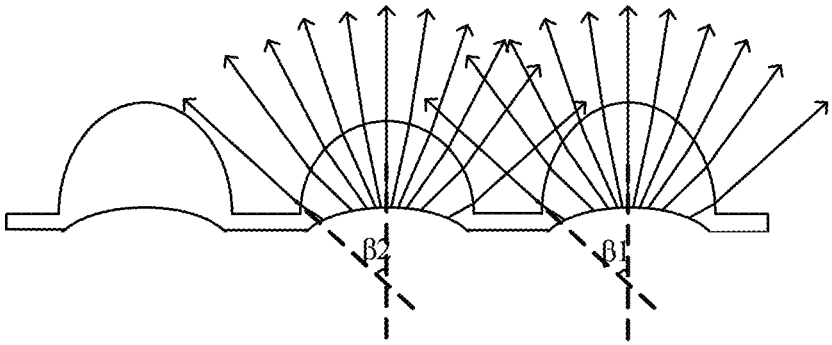
FIG. 14 is an optical path diagram that light emitted from the first light sources and light emitted from a second light source pass through the lens assembly in the third example of the present disclosure.

After the light emitted from the light source is refracted by the light-entering surface, the angle b ranges from 0° to 65°. After the light emitted from the light source is further refracted by the light-emitting surface, the angle c ranges from 0° to 50°. FIG. 14 is referred to, and FIG. 14 is an optical path diagram that the light emitted from the first light source and the light emitted from the second light source pass through the lens assembly. The light distribution is defined as a maximum angle between the light emitted from the light source, and passing through and refracted by the lens (the first lens 32 or the second lens 31) and the normal line. For example, for the first lens 32, the maximum angle between the light emitted from the first light source 42 and refracted by the first light-entering surface 322 and the first light-emitting surface 324 of the first lens 32 and the normal line is β1.

For the second lens 31, the maximum angle between the light emitted from the second light source 43 and refracted by the second light-entering surface and the second light-emitting surface of the second lens 31 and the normal line is β2. The light distribution of the light emitted from the first light source 42 and passing through the first lens 32 being the same as the light distribution of the light emitted from the second light source 43 and passing through the second lens 31 is understood that the angle β1 is equal to the angle β2. It can be seen that, in the example of the present disclosure, the first lens 32 is in the shape of the circular ring and the second lens 31 is in the shape of the dot. If the first cross section of the first lens 32 in the shape of the circular ring is the same as the second cross section of the second lens 31 in the shape of the dot, it will be difficult to achieve the effect that the light distribution of the light emitted from the first light source 42 and passing through the first lens 32 is exactly the same as the light distribution of the light emitted from the second light source 43 and passing through the second lens 31.

Therefore, in the present example, the first cross section of the first lens 32 is arranged to be not the same with the second cross section of the second lens 31, so that the light distribution types of the first lens and the second lens are the same (that is, the angle β1 is equal to the angle β2). Based on the above contents, the present disclosure achieves the same light distribution effect of the first lens 32 and the second lens 31 (that is, the angle β1 is equal to the angle β2) by arranging the cross section of the first lens 32 and the cross section of the second lens 31 to be different.

Generally, due to different manufacturing processes, the second lens 31 in the shape of the dot is rotationally symmetrical while the first lens 32 in the shape of the ring is not rotationally symmetrical. Assuming that the maximum angle β2 between the emitted light and the normal line is 60° after passing through the second lens 31 in the shape of the dot, if the cross section of the first lens 32 in the shape of the ring is arranged to be the same as the cross-section of the second lens 31, it is possible that the maximum angle β2 between the emitted light and the normal line is greater than 60° (for example, from 70° to 80°) after passing through the first lens 32. For the above reasons, in the present disclosure, in order to achieve the same light distribution effect of the first lens 32 in the shape of the ring and the second lens 31 in the shape of the dot, the present disclosure maintains the maximum angle β2 between the emitted light that is obtained after the light passing through the first lens 32 and the normal line to be 60° by changing the cross section of the first lens 32 by the manufacturing process. In each of the examples of the present disclosure, the methods of changing the cross section of the first lens 32 comprise changing curvatures of the first light-entering surface 322 and the first light-emitting surface 324 of the first lens 32, or changing a height of the first lens 32, or changing a width of the first lens 32 and so on, which are not limited in the present disclosure.

In summary, in the lens assembly used in the illumination device according to the third example of the present disclosure, because the light distribution of the light emitted from the first light sources placed in the first placement space after passing through the first light-entering surface and the first light-emitting surface is the same with the light distribution of the light emitted from the second light source placed in the second placement space after passing through the second light-entering surface and the second light-emitting surface. Thus, the first lens and the second lens in the lens assembly have the same light distribution effect, and it avoids the case that one lens is arranged for each of the light sources to cover each of the light sources. Thereby the lighting effect of the illumination device is improved.

Figure 15:
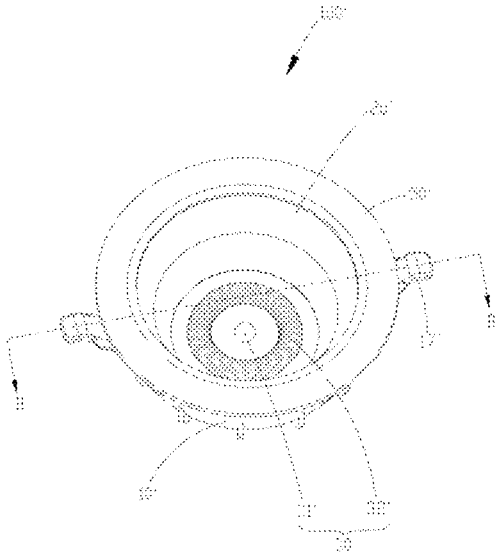
FIG. 15 is a three-dimensional diagram of an illumination device provided by a fourth example of the present disclosure.
Figure 16:
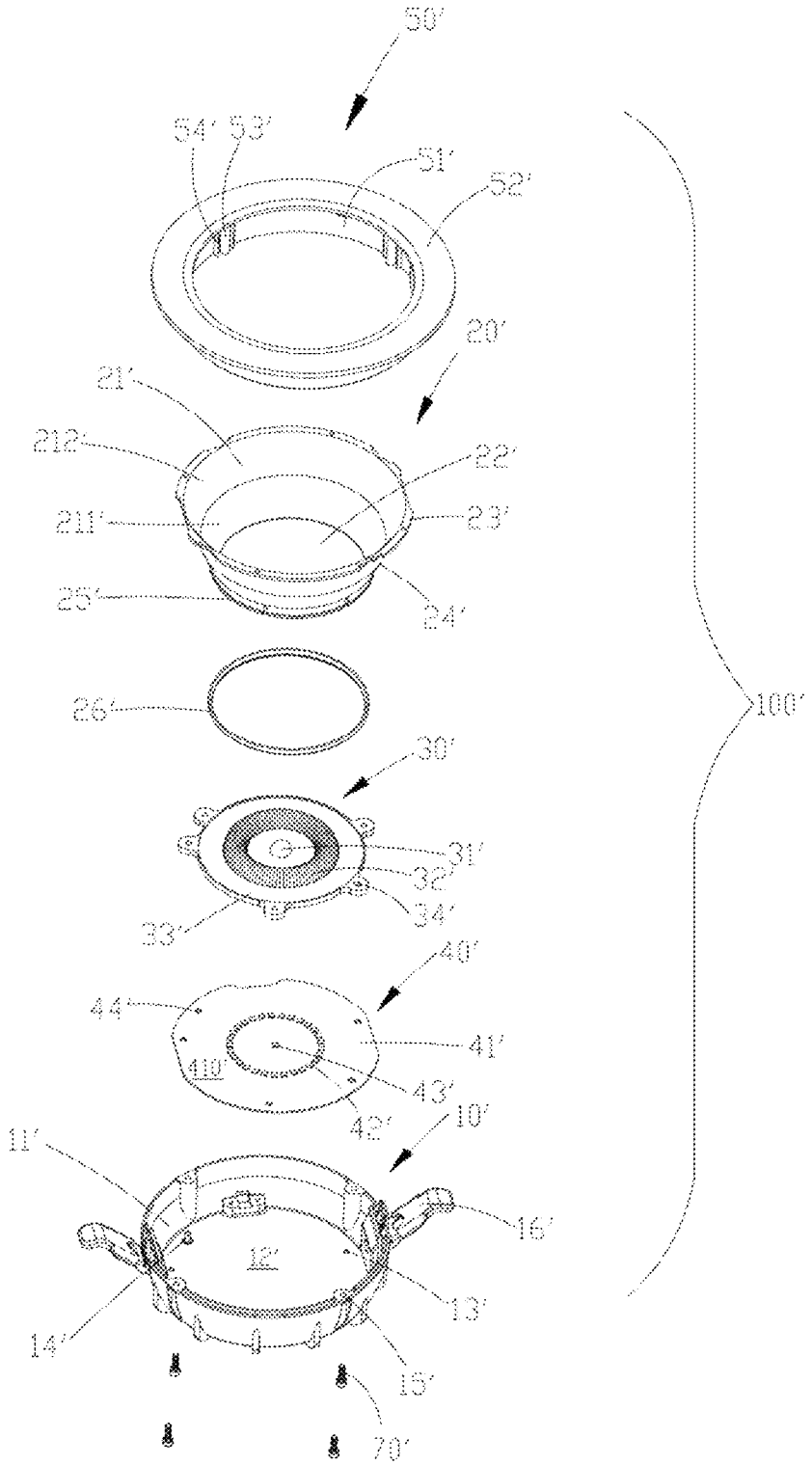
FIG. 16 is a three-dimensional exploded diagram of the illumination device provided by the fourth example of the present disclosure.
Figure 17:
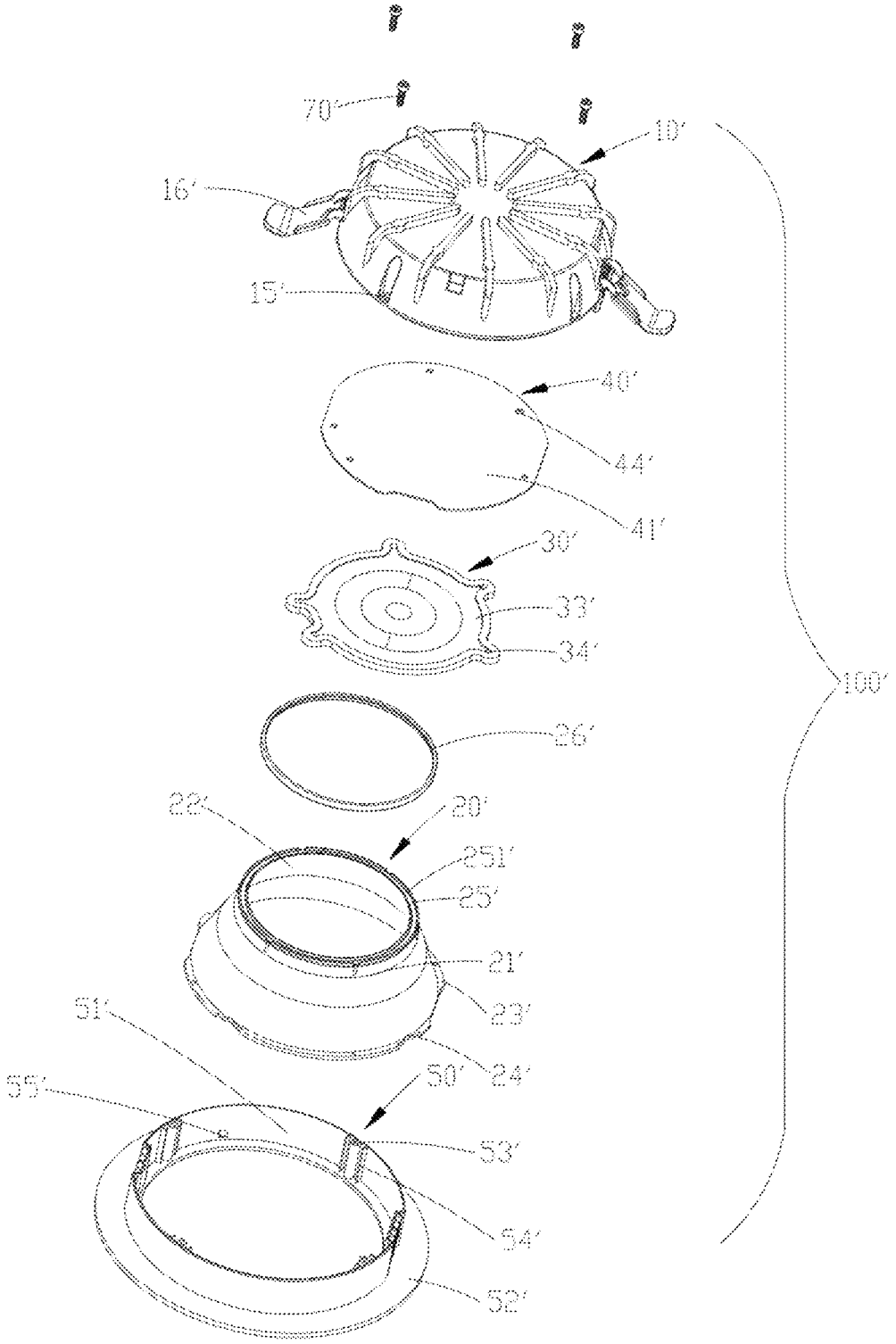
FIG. 17 is a three-dimensional exploded diagram, viewed from another direction, of the illumination device provided by the fourth example of the present disclosure.

As illustrated in FIG. 15 to FIG. 17, the illumination device 100' of the present example comprises a shell 10', a face ring 50' connected with the shell 10', a light source module 40' arranged in the shell 10', and a lens assembly 30' matched with the light source module 40'.

The light source module 40' comprises a substrate 41', a plurality of first light sources 42' arranged in a ring and on a first surface 410' of the substrate 41', and at least one second light source 43' arranged on the first surface 410' of the substrate 41'. The at least one second light source 43' is located at a center of the ring of the first light sources 42'. The first light sources 42' and the second light source 43' are light-emitting diodes (LEDs) or other types of light-emitting elements. The light source module 40' further comprises an electronic element (not shown in the drawings) arranged on the substrate 41'. The light source module 40' may be integrated with a driving power module (not shown in the drawings) for driving the light source module 40', and the driving power module is integrated on the first surface 410' of the substrate 41' or on a second surface opposite to the first surface.

Figure 18:
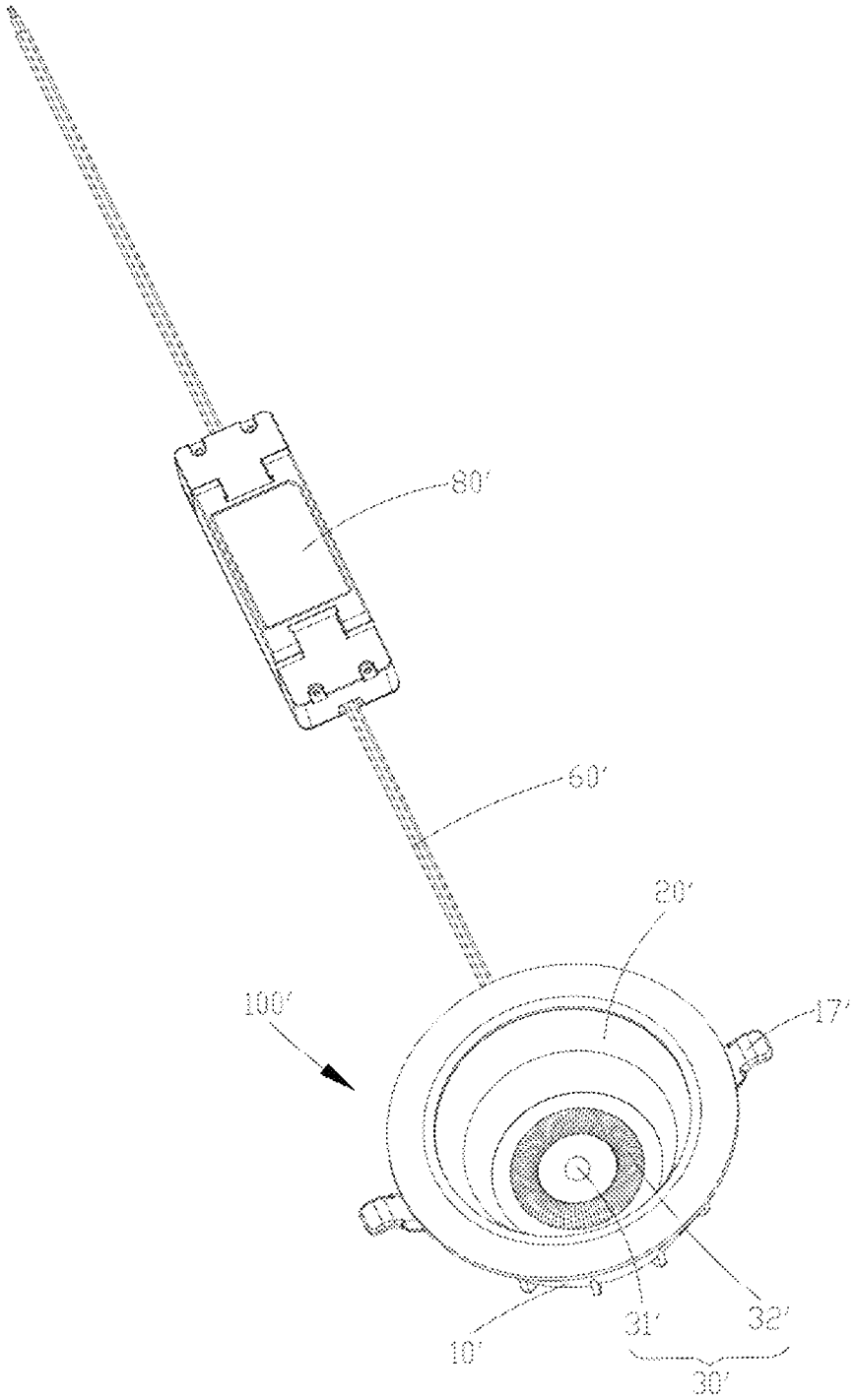
FIG. 18 is a three-dimensional diagram of the illumination device connected to a driving power module provided by the fourth example of the present disclosure.

The driving power module may be arranged externally. As illustrated in FIG. 18, the illumination device 100' further comprises the driving power module 80', and the driving power module 80' is electrically connected with the light source module 40' in the shell 10' by a wire 60'.

Correspondingly, the lens assembly 30' comprises: a base 33' for matching with the substrate 41' of the light source module 40', a first lens 32' in a shape of a circular ring and connected to the base 33', and a second lens 31' connected to the base 33' and located at a ring center of the first lens 32'. The first lens 32' is matched with the first light source 42' of the light source module, and the second lens 31' is matched with the second light source 43' of the light source module 40'.

It should be noted that, the lens assembly 30' is a lens component comprising at least two lenses, the at least two lenses are integrally arranged or separately arranged, and the number of the lenses in the lens assembly 30' is not limited. In the example of the present application, the second lens 31' is in a shape of a circular ring or in a shape of a non-circular ring (for example, in a shape of a dot). Preferably, in a case that both the first lens 32' and the second lens 31' are in the shape of the circular ring, the ring center of the first lens 32' (that is, a center of the ring formed by the lens) coincides with a ring center of the second lens 31'. In a case that the first lens 32' is in the shape of the circular ring and the second lens 31' is in the shape of the dot, the second lens 31' is located at the ring center of the first lens 32'. Further, in a case that the second lens 31' is in a shape of a round dot, a center of the round dot of the second lens 31' is arranged to be coincide with the ring center of the first lens 32'. In other feasible examples of the present application, a position relationship between the first lens 32' and the second lens 31' is not limited.

Preferably, in order to further enhance the lighting effect and aesthetics of the illumination device 100', the illumination device 100' further comprises a reflective component 20' arranged between the shell 10' and the face ring 50' and arranged in a ring, and the reflective component 20' is provided on an outer side of the first lens 32' and surrounds the first lens 32'. The reflective component 20' comprises an inclined reflective surface 21', a horizontal upper end surface 23' and a horizontal lower end surface 25' respectively provided on two sides of the reflective surface 21', and an opening 22' for the lens assembly 30' to pass through during the process of installation. The reflective surface 21' comprises a first reflective surface 211' and a second reflective surface 212', the first reflective surface 211' is inclined and the second reflective surface 212' is curved. The lower end surface 25', the first reflective surface 211', the second reflective surface 212', and the upper end surface 23' are connected sequentially. The upper end surface 23' is provided with a plurality of guide grooves 24', and the lower end surface 25' is provided with a ring-shaped accommodation groove 251'. A washer 26' is accommodated in the accommodation groove 251', and the washer 26' is used for improving waterproof sealing performance of the illumination device 100'. The reflective component 20' may adopt electroplated mirror reflection, diffuse reflection, absorption type reflection and the like to achieve controlling of glare. In addition, a portion of the reflective surface 21' is curved and a portion of the reflective surface 21' is straight, which makes the light spot more uniform.

In the example of the present disclosure, the shell 10' comprises a bottom wall 12' and a side wall 11' connected to the bottom wall 12', and a plurality of screw holes 13' for fixing and a positioning pillar 14' are arranged on the bottom wall 12, and correspondingly, a plurality of through-holes 44' are arranged on the substrate 41 of the light source module 40. A plurality of through holes 34' for fixing are arranged on the base 33' of the lens assembly 30'. The side wall 11 of the shell 10 is further provided with a plurality of screw holes 15' for fixing extended from an outer surface to an end surface, and two clamp springs 16' are connected on the side wall 11'.

The face ring 50' comprises a side wall 51' and a ring surface 52' connected to the side wall 51', an inner surface of the side wall 51' is provided with a plurality of positioning pillars 53', both sides of each of the positioning pillars 53' are provided with a rib 54', the positioning pillars 53' match with the screw holes 15' for fixing, the ribs 54' match with the guide grooves 24' to play a role of guiding during assembling the reflective component 20'. A plurality of protrusions 55' are further arranged on an inner surface of the side wall 51' and close to the ring surface 52', and the upper end surface 23' of the reflective component 20' is positioned between the ring surface 52' and the protrusions 55' of the face ring 50'.

In the process of installing, the light source module 40' is placed on the bottom wall 12' of the shell 10' firstly, and in the process of placing, the plurality of through-holes 44' of the light source module 40' are respectively fitted to the plurality of screw holes 13' for fixing and the positioning pillars 14' on the bottom wall 12' respectively. Then the lens assembly 30' is placed on the first surface 410' of the substrate 41' provided with the first light source 42'. In the placement process, the positions of the through holes 34' for fixing of the lens assembly 30' are aligned with the positions of the plurality of through-holes 44' of the light source module 40'. Then the light source module 40' and the lens assembly 30' are fixed in the shell 10' by bolts (not shown) matching with the screw holes 13' for fixing.

An assembling mode of the light source module 40' and the lens assembly 30' is not limited to the above mode, and a mode of sticking, a mode of riveting and the like may be used. Subsequently, the reflective component 20' is placed on the base 33' of the lens assembly 30', and the reflective surface 21' surrounds the first lens 32' of the lens assembly 30'. The shell 10', the reflective component 20' and the face ring 50' are connected and fixed through the bolts 70' passing through the screw holes 16' for fixing and accommodated in the positioning pillars 53'.

Figure 19:
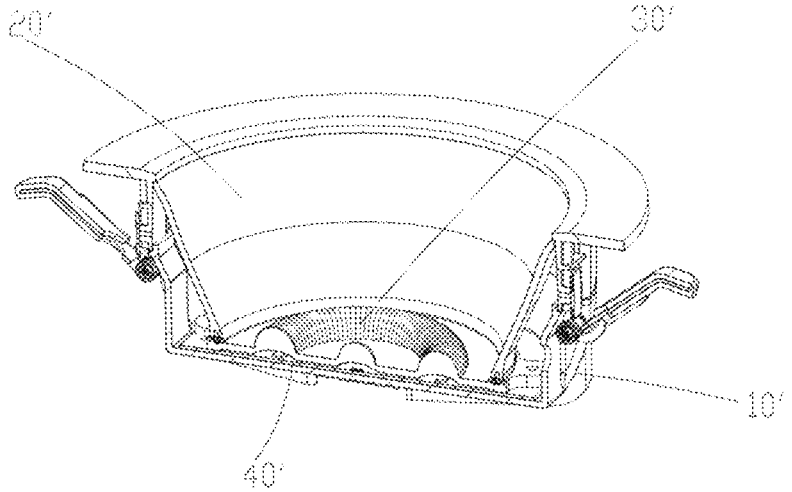
FIG. 19 is a three-dimensional cross-sectional schematic diagram of the illumination device taken along a direction of a B-B line of FIG. 5.
Figure 20:
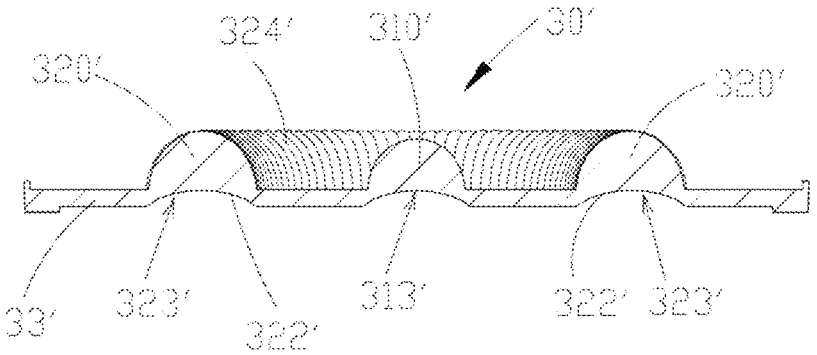
FIG. 20 is a cross-sectional schematic diagram of a lens assembly taken along the direction of the B-B line of FIG. 5.
Figure 21:
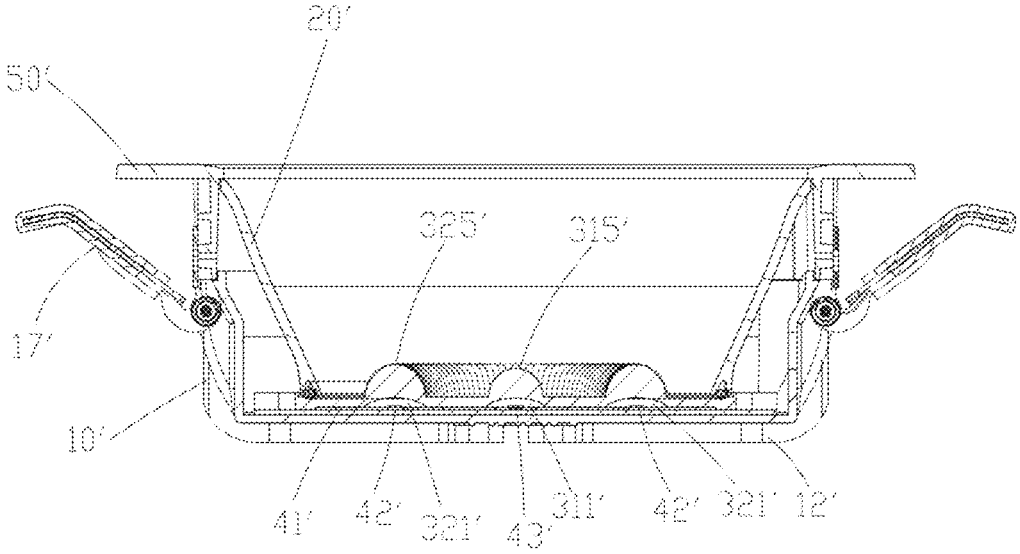
FIG. 21 is a main view of the three-dimensional cross-sectional schematic diagram shown in FIG. 19.

Similarly, the assembling of the above reflective component 20' and the shell 10' is not limited to the above mode, and a mode of sticking, a mode of riveting and the like may be used. FIG. 19 to FIG. 21 are referred to, the cross sections shown in FIG. 19 to FIG. 21 are taken along a second section line (a B-B direction shown in FIG. 15), and the second section line passes through the ring center of the first lens 32'. The first lens 32' comprises a first lens body 320' in a ring shape and a first groove 323' recessing inward from the base 33', and the second lens 31' comprises a second lens body 310' and a second groove 313' recessing inward from the base 33'. The first lens 32' comprises a first light-entering surface 322' and a first light-emitting surface 324' opposite to each other. After the lens assembly 30' and the light source module 40' are installed with each other, due to the existence of the first groove 323', a first cavity 321' for placing the first light sources 42' is formed between the first light-entering surface 322' and the first surface 410' (as illustrated in FIG. 16).

Figure 22:
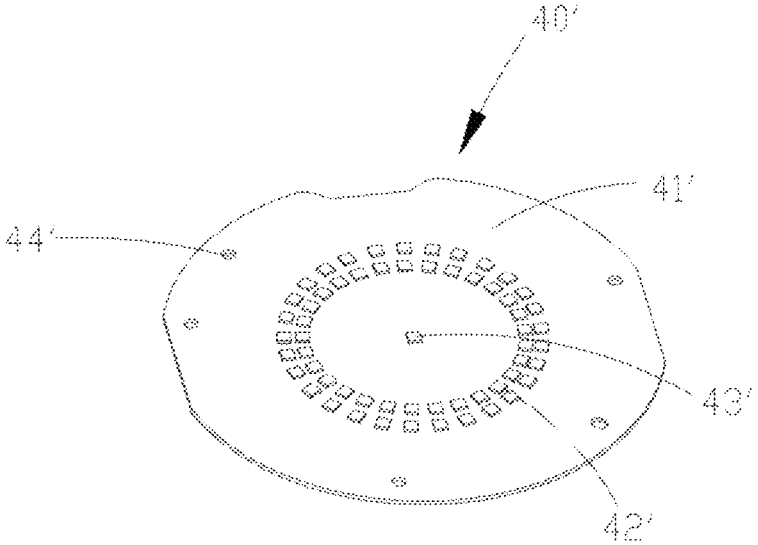
FIG. 22 is another schematic diagram of an arrangement of first light sources of a light source module in the fourth example of the present disclosure.

Similarly, the second lens 31' comprises a second light-entering surface and a second light-emitting surface opposite to each other. After the lens assembly 30' and the light source module 40' are installed with each other, due to the existence of the second groove 313', a second cavity 311' for placing the second light source 43' is formed between the second light-entering surface 312' and the first surface 410'. The example of the present disclosure places the first light sources 42' arranged in the ring of the light source module 40' in the first cavity 321' of the first lens 32'. In the present example, the first light sources 42' are arranged in the ring. In other alternative examples, as illustrated in FIG. 22, the first light sources 42' are arranged in two rings or more rings, so that more light sources are arranged in a limited space of the illumination device 100', thereby the lighting effect of the illumination device 100' is improved. In addition, by adjusting the lens assembly 30, the number of the first light sources 42 located in the first lens 32 is adjusted according to the required luminous flux. Moreover, the lens assembly 30 is compatible with a variety of packages and thus has a good compatibility, and the arrangement of the light sources on the substrate 41' is more flexible.

It should be noted that, in the example of the present disclosure, both the first light-entering surface 322' and the first light-emitting surface 324' of the first lens 32' are curved surfaces, and a curvature radius of the first light-entering surface 322' is larger than a curvature radius of the first light-emitting surface 324'. Thus, after the light sources of the illumination device are installed in the lens assembly 30', the light emitted from the light sources emits outward after completely passing through the lens assembly 30'. The first lens 32' having the curved surfaces makes the luminous efficiency and the light distribution effect better. In the example of the present disclosure, the substrate 41' of the light source module 40' is attached with the base 33' of the lens assembly 30' to form the first cavity or the second cavity enclosed by the substrate 41' and the base 33'. Therefore, each of the first light sources and the second light source are completely accommodated in the first cavity 321' or the second cavity 311', so as to ensure that all light passes through the lens assembly 30' and then emits outside the illumination device, and the luminous efficiency is high.

Referring to FIG. 19, in order to make the light distribution effect of light emitted from each of the light sources and passing through the above lens assembly 30' in the illumination device is uniform, in the present example, a first cross section of the first lens 32' taken along the second section line is not the same as a second cross section of the second lens 31' taken along the first section line. In the present example, a height of the first lens 32' in a thickness direction of the base 33' is not equal to a height of the second lens 31' in the thickness direction of the base 33'. That is to say, the height of the first lens 32' in the thickness direction of the base 33' is defined as a first vertical distance from a first top 325' of the first lens 32' to the base 33', the height of the second lens 31' in the thickness direction of the base 33' is defined as a second vertical distance from a second top 315' of the second lens 31' to the base 33', then the first vertical distance is larger or less than the second vertical distance. In an example, the first vertical distance is arranged to be larger than the second vertical distance.

Figure 23:
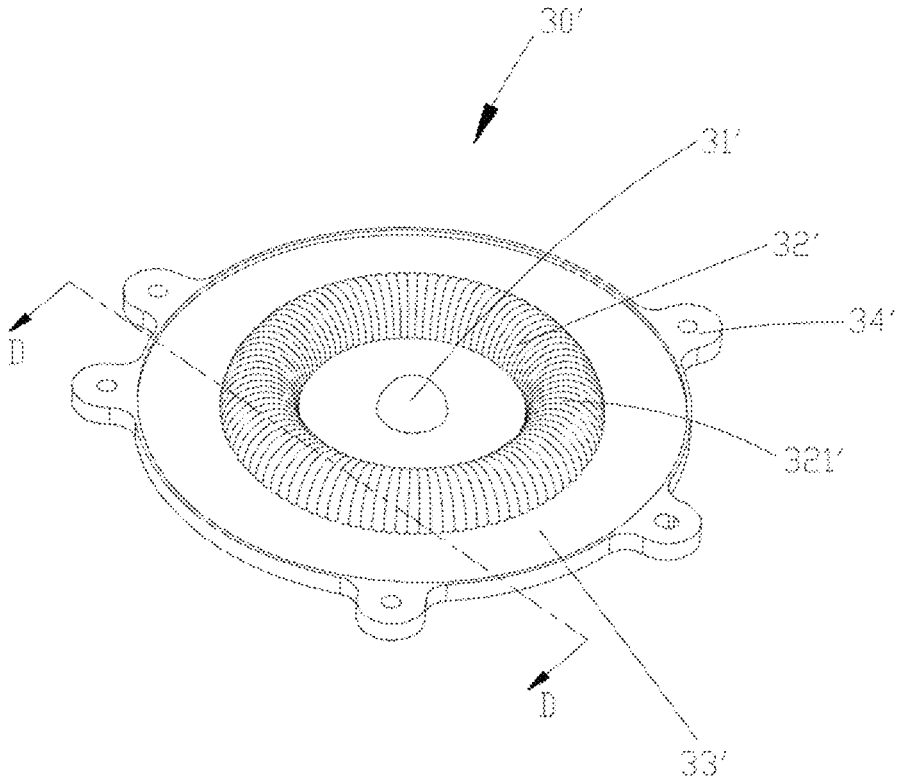
FIG. 23 is a structural schematic diagram of the lens assembly on a side provided with a light-entering surface in the fourth example of the present disclosure.
Figure 24:
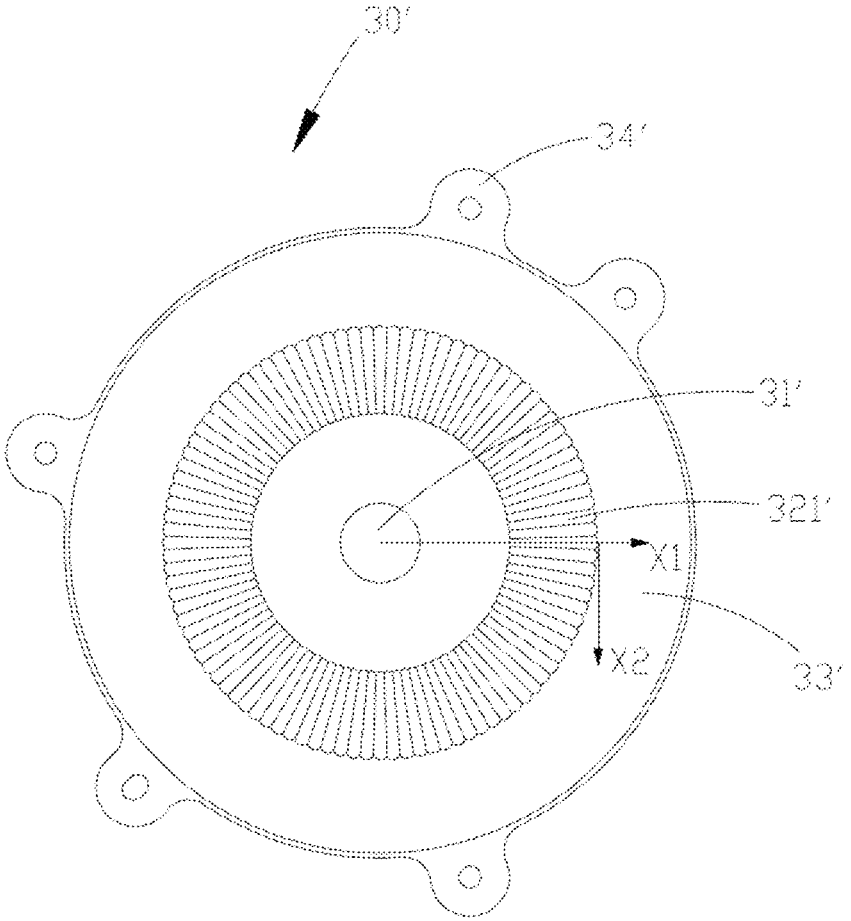
FIG. 24 is a top schematic diagram of the lens assembly in the fourth example of the present disclosure.

FIG. 24 shows a top schematic diagram of the lens assembly in the fourth example of the present disclosure. In a case that an outer surface of the first lens 32' in the shape of the ring is smooth, a light control is achieved only along a radial X1 and a light control is not achieved along a tangential direction X2. A bright circle is prone to be formed after the light reflected by the reflective component 20', which affects the uniformity of the light spots. Therefore, in the present example, the lens assembly 30' as illustrated in FIG. 23 avoids the occurrence of the bright circle and improves the visual effect. In the present example, a plurality of ridges 321' distributed uniformly are arranged on the first light surface 324' of the first lens 30', and each of the ridges 321' appears as a curve protruding along the first light surface 324' of the first lens 30'. Specifically, each of the ridges 321' extends along the radial direction X1 of the first lens, and the projection thereof in a horizontal direction is a straight line.

In the present example, a curvature of each of the ridges 321' is the same as a curvature of the first light-emitting surface or the first light-entering surface 324'. The plurality of ridges 321' are arranged at an equal interval along the extension direction, so that the light along the tangential direction X2 is further dispersed to achieve uniformity of the light spots. The ridges 321' may be arranged on both of the first light-entering surface 322' and the first light-emitting surface 324'. In a same principle, the plurality of ridges 321' are arranged at an equal interval on the second light-entering surface or the second light-emitting surface of the second lens 31'.

Figure 25:
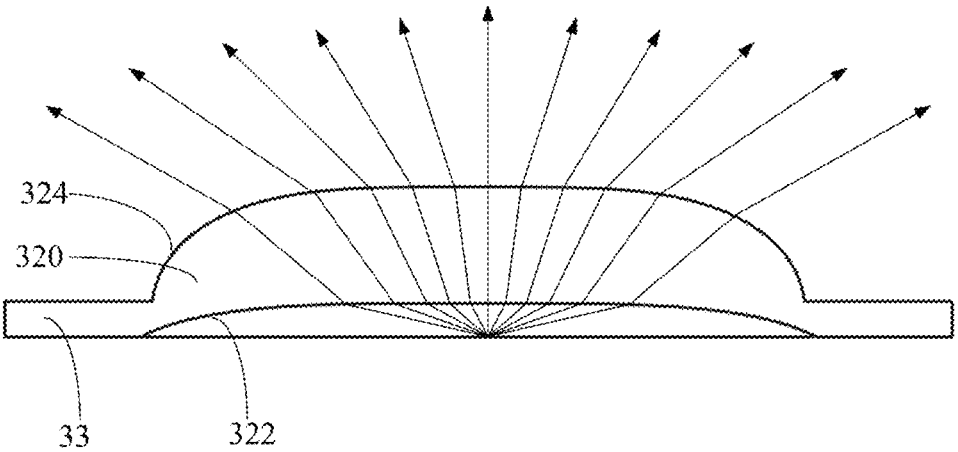
FIG. 25 is an optical path diagram at a cross-section of the lens assembly taken along a direction of a C-C line of FIG. 6 in the third example.
Figure 26:
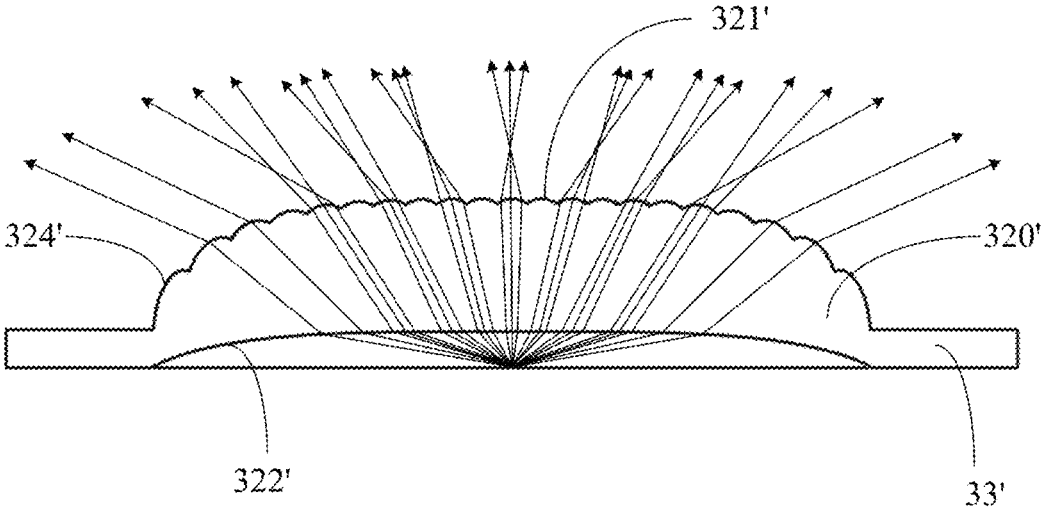
FIG. 26 is an optical path diagram at a cross-section of the lens assembly taken along a direction of a D-D line of FIG. 23 in the fourth example.

As illustrated in FIG. 25, the first light-emitting surface 324 of the first lens 32 is smooth. The light enters from the first light-entering surface 322 of the first lens 32 and emits from the first light-emitting surface 324. As illustrated in FIG. 26, the plurality of ridges 321' are arranged on the first light-emitting surface 324' of the first lens 32', and the light enters from the first light-entering surface 322' of the first lens 32' and emits from the first light-emitting surface 324'. Comparing the optical path diagram shown in FIG. 26 with the optical path diagram shown in FIG. 25 and comparing the first lens 32' with the first lens 32, because the first light-emitting surface 324' is provided with the ridges 321', the light incident on different ridges 321', and the light having different incident angles is scattered out after being refracted by the ridges 321', that is, the emitted light is further scattered, which eliminates the problem that the light control is not achieved along the tangential direction X2 of the first lens 32 and thus form the bright circle.

Both the first light-entering surface 322' and the second light-entering surface may adopt etched structures or abrasive structures, which makes a beam angle of the light emitted from the first light source 42' meet a desired requirement after passing through the lens assembly 30'.

In summary, the lens assembly 30' used in the illumination device of the fourth example avoids the formation of the bright circle by the light emitted from the light-emitting surface by sequentially arranging the plurality of ridges along the extension direction of the lens, further the uniformity of the light spots is improved and the lighting effect of the illumination device is improved.

The purpose of the present disclosure is to provide a lens assembly and an illumination device having the lens assembly, and to solve the problem that it is difficult to ensure that the light emitted from the different light sources and passing through different lens disposed on the different light sources can obtain a uniform light distribution.

In order to achieve the above purpose, the lens assembly and the illumination device having the lens assembly according to the examples of the present disclosure are realized as follows.

A lens assembly, for at least placing a first light source and a second light source is provided. The lens assembly comprises: a first lens, in which the first lens is in a shape of a ring and comprises a first light-entering surface, a first light-emitting surface and a first placement space on a side of the first light-entering surface for placing the first light source, and both the first light-entering surface and the first light-emitting surface are curved surfaces; a second lens, in which the second lens comprises a second light-entering surface, a second light-emitting surface and a second placement space on a side of the second light-entering surface for placing the second light source, and both the second light-entering surface and the second light-emitting surface are curved surfaces; the first light-emitting surface and/or the first light-entering surface is provided with a plurality of ridges uniformly distributed along an extension direction of the first lens, each of the ridges extends in a shape of a curve along the first lens, and a projection of each of the ridges in a horizontal direction is a straight line.

Further, each of the ridges extends in the shape of the curve along a radial direction of the first lens.

Further, a curvature of each of the ridges is the same as a curvature of the first light-emitting surface or the first light-entering surface.

Further, the first lens and the second lens are integrally arranged or separately arranged.

Further, the first lens is in a shape of a circular ring, and the plurality of ridges are uniformly distributed along a circumferential direction of the first lens.

Further, the first lens is configured that an angle between an incident light from the first light source and a normal line is greater than an angle between the normal line and an emitted light obtained after the incident light passes through the first light-entering surface and the first light-emitting surface; the second lens is configured that an angle between an incident light from the second light source and a normal line is greater than an angle between the normal line and an emitted light obtained after the incident light passes through the second light-entering surface and the second light-emitting surface.

Further, the second lens is in a shape of a circular ring or in a shape of a dot; in a case that the second lens is in the shape of the circular ring, a ring center of the first lens coincides with a ring center of the second lens; in a case that the second lens is in the shape of the dot, the second lens is located at the ring center of the first lens.

Further, a first cross section of the first lens taken along a first section line is not the same as a second cross section of the second lens taken along the first section line, and the first section line passes through the ring center of the first lens.

Further, the second lens is in the shape of the circular ring, and the second light-emitting surface and/or the second light-entering surface is provided with a plurality of ridges uniformly distributed along a circumferential direction of the second lens, each of the ridges extends in a shape of a curve along a radial direction of the second lens.

An illumination device having a lens assembly is provided, and the illumination device comprises: a shell; a light source module located in the shell, in which the light source module comprises a substrate and a first light source and a second light source arranged on the substrate; and a lens assembly matched with the light source module. The lens assembly comprises: a first lens, in which the first lens comprises a first light-entering surface, a first light-emitting surface and a first placement space on a side of the first light-entering surface for placing the first light source, and both the first light-entering surface and the first light-emitting surface are curved surfaces; a second lens, in which the second lens comprises a second light-entering surface, a second light-emitting surface and a second placement space on a side of the second light-entering surface for placing the second light source, and both the second light-entering surface and the second light-emitting surface are curved surfaces; the first light-emitting surface and/or the first light-entering surface is provided with a plurality of ridges uniformly distributed along an extension direction of the first lens, each of the ridges extends in a shape of a curve along the first lens, and a projection of each of the ridges in a horizontal direction is a straight line.

Further, the illumination device further comprises a reflective component arranged in the shell and arranged in a ring.

Further, the reflective component comprises a first reflective surface in a shape of a ring and a second reflective surface in a shape of a ring, the first reflective surface is a straight surface, and the second reflective surface is a curved surface.

Further, the first light source is accommodated in the first lens, and the second light source is accommodated in the second lens.

Further, the first lens is in a shape of a circular ring, and the first light source is in a shape of a single ring or in a shape of multiple rings.

Further, the illumination device further comprises a driving power module electrically connected with the light source module.

It can be seen from the technical solutions provided by the present disclosure, the lens assembly in the illumination device avoids the formation of a bright circle by the light emitted from the light-emitting surface by arranging the plurality of ridges along the extension direction of the light-emitting surface of at least one of the first lens and the second lens, further improves the uniformity of the light spots and improves the lighting effect of the illumination device.

The present discloses provides a method of manufacturing a LED lighting device. The method may include providing a housing, a light source component, and an optical lens located above the light source component and where the optical lens is configured to distribute light for the light source component; providing a reflector in contact with the optical lens and a surface ring assembled on the reflector; sequentially arranging the housing, the light source component, the optical lens, the reflector and the surface ring; fixing the surface ring on the housing to delimit a receiving chamber, and positioning the light source component, the optical lens and the reflector in the receiving chamber; and placing the LED light source particles on a light source base plate comprised in the light source component where light of the LED light source particles sequentially passes through the optical lens and the reflector and then emits through a light exit of the LED lighting device.

The method may also include sandwiching the reflector between the surface ring and the optical lens.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected The specific examples described above further describe the objectives, technical solutions and beneficial effects of the present disclosure in detail. It should be understood that the above descriptions are merely specific examples of the present disclosure and are not intended to limit the present disclosure. Any modification, equivalent replacement, improvement, etc. made within the spirit and principle of the present disclosure should be included in the protection scope of the present disclosure.

What is claimed is:

1. A LED lighting device, comprising:

a housing, a light source component, an optical lens located above the light source component and wherein the optical lens is configured to distribute light for the light source component, a reflector in contact with the optical lens, and a surface ring assembled on the reflector; and wherein:

the housing, the light source component, the optical lens, the reflector and the surface ring are sequentially arranged;

the surface ring is fixed on the housing to delimit a receiving chamber, the light source component, the optical lens and the reflector are located in the receiving chamber;

the light source component comprises a light source base plate and LED light source particles are located on the light source base plate, light of the LED light source particles sequentially passes through the optical lens and the reflector and then emits through a light exit of the LED lighting device; and the optical lens comprises a first lens, a second lens, and a third lens, the second and the third lens are both annular lenses surrounding the first lens, and a height of the first lens is greater than a height of the second lens and is greater than a height of the third lens, and the second lens and the third lens have a same height.

2. The LED lighting device according to claim 1, wherein the light source component is snap-fitted with the optical lens.

3. The LED lighting device according to claim 1, wherein the reflector is sandwiched between the surface ring and the optical lens.

4. The LED lighting device according to claim 1 wherein a height of the reflector is greater than two times of a height of the optical lens.

5. The LED lighting device according to claim 1, wherein a height of the reflector is greater than three times of a height of the optical lens.

6. The LED lighting device according to claim 1, wherein the optical lens is selected from the group consisting of a ring lens, a single lens, and a lens array.

7. The LED lighting device according to claim 1, wherein a diameter of the reflector is gradually increased from an end of the reflector connected to the optical lens to another end of the optical lens.

8. The LED lighting device according to claim 1, wherein the reflector and the optical lens are fixed between the surface ring and the housing by using the surface ring to press and connect the reflector and the optical lens.

9. The LED lighting device according to claim 1, wherein:

a portion of the light emitted from the LED light source particles is emitted through the light exit, and another portion of the light emitted from the LED light source particles is reflected by the reflector and then emitted through the light exit; and the light emitted from the LED light source particles, upon passing through the optical lens, is reflected by the reflector firstly and then emitted through the light exit of the LED lighting device.

10. The LED lighting device according to claim 1, wherein the light source component comprises three portions corresponding to the first lens, the second lens and the third lens of the optical lens, respectively.

11. The LED lighting device according to claim 10, wherein:

the first lens, the second lens, and the third lens are disposed on the light source component and each cover a corresponding light source, or the first lens, the second lens, and the third lens are connected to have an integral structure.

12. The LED lighting device according to claim 10, wherein the first lens that is centrally located is a dot lens and corresponds to at least one LED light source particle.

13. The LED lighting device according to claim 1, further comprising a snap spring component disposed at a periphery of the housing.

14. The LED lighting device according to claim 1, wherein the LED lighting device is a downlight.

15. A lens assembly for at least placing a first light source and a second light source, comprising:

a first lens, wherein the first lens is in a shape of a ring and comprises a first light-entering surface, a first light-emitting surface and a first placement space on a side of the first light-entering surface for placing the first light source, and both the first light-entering surface and the first light-emitting surface are curved surfaces;

a second lens, wherein the second lens comprises a second light-entering surface, a second light-emitting surface and a second placement space on a side of the second light-entering surface for placing the second light source, and both the second light-entering surface and the second light-emitting surface are curved surfaces; and wherein the first light-emitting surface and/or the first light-entering surface is provided with a plurality of ridges uniformly distributed along an extension direction of the first lens, each of the ridges extends in a shape of a curve along the first lens; and a curvature of each of the ridges is the same as a curvature of the first light-emitting surface or the first light-entering surface.

16. The lens assembly according to claim 15, wherein each of the ridges extends in the shape of the curve along a radial direction of the first lens.

17. A method of manufacturing a LED lighting device, comprising:

providing a housing, a light source component, and an optical lens located above the light source component and wherein the optical lens is configured to distribute light for the light source component;

providing a reflector in contact with the optical lens and a surface ring assembled on the reflector;

sequentially arranging the housing, the light source component, the optical lens, the reflector and the surface ring;

fixing the surface ring on the housing to delimit a receiving chamber, and positioning the light source component, the optical lens and the reflector in the receiving chamber; and placing the LED light source particles on a light source base plate comprised in the light source component wherein light of the LED light source particles sequentially passes through the optical lens and the reflector and then emits through a light exit of the LED lighting device, wherein the optical lens comprises a first lens, a second lens, and a third lens, the second and the third lens are both annular lenses surrounding the first lens, and a height of the first lens is greater than a height of the second lens and is greater than a height of the third lens, and the second lens and the third lens have a same height.

18. The method according to claim 17, further comprising sandwiching the reflector between the surface ring and the optical lens.

* * * * *